US012723580B2

(12) United States Patent
Hurst et al.

(10) Patent No.: US 12,723,580 B2
(45) Date of Patent: Sep. 1, 2026

(54) BELLOWS FAILURE DETECTION FOR A PUMP

(71) Applicant: Halliburton Energy Services, Inc., Houston, TX (US)

(72) Inventors: Justin Lee Hurst, Duncan, OK (US); Timothy Holiman Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/398,858

(22) Filed: Dec. 28, 2023

(65) Prior Publication Data

US 2024/0376881 A1 Nov. 14, 2024

Related U.S. Application Data

(60) Provisional application No. 63/501,980, filed on May 12, 2023.

(51) Int. Cl.

| | |
|---|---|
| ***F04B 43/00*** | (2006.01) |
| ***E21B 43/25*** | (2006.01) |
| ***F04B 51/00*** | (2006.01) |

(52) U.S. Cl.

CPC ..... *F04B 43/0054* (2013.01); *E21B 43/25* (2013.01); *F04B 43/009* (2013.01);

(Continued)

(58) Field of Classification Search

CPC .... F04B 43/0054; F04B 43/009; F04B 51/00; F04B 2201/0208; F04B 2201/0803; E21B 43/25

(Continued)

(56) References Cited

U.S. PATENT DOCUMENTS

| | | | |
|---|---|---|---|
| 1,256,127 | A | 2/1918 | Gould |
| 1,301,485 | A | 4/1919 | Mueller |

(Continued)

FOREIGN PATENT DOCUMENTS

| | | | |
|---|---|---|---|
| CN | 201982789 | U | 9/2011 |
| CN | 104763410 | A | 7/2015 |

(Continued)

OTHER PUBLICATIONS

English Langauge Translation of JP 01257775 A, via J-Plat Pat. (Year: 1989).*

(Continued)

*Primary Examiner* — Charles G Freay

(74) *Attorney, Agent, or Firm* — Conley Rose, P.C.; Rodney B. Carroll

(57) ABSTRACT

In a bellows pump, detecting any leakage with respect to the bellows can be important, for example for pump durability and life. Disclosed embodiments relate to a bellows pump system in which the bellows is configured to form an annulus, such that fluid in the annulus may be monitored in order to detect leakage. For example, a double-walled bellows may include an annulus between the walls, and the annulus may be in fluid communication with a port. Detection of fluid at the port may be indicative of leakage, and one or more action may be taken in response to such fluid detection. In some embodiments, the double-walled bellows may be formed by having an elastomeric liner disposed within a single-walled bellows, which may have an accordion-like configuration. Related methods and systems are also disclosed.

19 Claims, 8 Drawing Sheets

(52) U.S. Cl.
CPC ..... *F04B 51/00* (2013.01); *F04B 2201/0208* (2013.01); *F04B 2201/0803* (2013.01)

(58) Field of Classification Search
USPC ..... 417/398, 472; 92/34, 35, 37, 38, 45
See application file for complete search history.

(56) References Cited

U.S. PATENT DOCUMENTS

| | | | | |
|---|---|---|---|---|
| 1,650,377 | A | 11/1927 | Nixon | |
| 1,832,257 | A | 11/1931 | Stephens | |
| 2,464,095 | A | 3/1949 | Nies | |
| 2,546,302 | A | 3/1951 | Gehres et al. | |
| 2,613,607 | A | 10/1952 | Sheen et al. | |
| 2,735,369 | A | 2/1956 | Turvey | |
| 2,807,215 | A | 9/1957 | Hawxhurst | |
| 3,134,508 | A | 5/1964 | Yer et al. | |
| 3,151,562 | A | 10/1964 | Swartz | |
| 3,192,860 | A | 7/1965 | Hardison | |
| 3,338,170 | A | 8/1967 | Swartz | |
| 3,411,452 | A | 11/1968 | Czarnecki et al. | |
| 3,433,161 | A | 3/1969 | Vetter | |
| 3,524,714 | A | 8/1970 | Grove et al. | |
| 3,680,981 | A | 8/1972 | Wagner | |
| RE29,055 | E | 11/1976 | Wagner | |
| 4,003,679 | A | 1/1977 | McManigill | |
| 4,080,107 | A | 3/1978 | Ferrentino | |
| 4,406,595 | A | 9/1983 | Robertson et al. | |
| 4,439,112 | A | 3/1984 | Kitsnik | |
| 4,442,957 | A * | 4/1984 | Neal | B60T 17/006 222/207 |
| 4,594,057 | A | 6/1986 | Morgan | |
| 4,948,349 | A | 8/1990 | Koiwa | |
| 4,971,523 | A * | 11/1990 | Wacker | F04B 43/009 417/63 |
| 5,062,770 | A * | 11/1991 | Story | F04B 43/009 417/63 |
| 5,188,515 | A * | 2/1993 | Horn | F04B 43/009 417/63 |
| 5,220,943 | A | 6/1993 | Zink | |
| 5,246,351 | A | 9/1993 | Horn et al. | |
| 5,249,932 | A | 10/1993 | Van Bork | |
| 5,308,230 | A | 5/1994 | Moore | |
| 6,419,462 | B1 | 7/2002 | Horie et al. | |
| 6,554,578 | B1 | 4/2003 | Siegel | |
| 9,243,413 | B2 | 1/2016 | Robol et al. | |
| 9,518,577 | B2 | 12/2016 | van Boeyen et al. | |
| 10,408,204 | B2 | 9/2019 | Suzuki | |
| 10,408,207 | B2 | 9/2019 | Yamada et al. | |
| 10,480,296 | B2 | 11/2019 | Beisel | |
| 10,895,254 | B2 | 1/2021 | Beisel | |
| 10,947,967 | B1 | 3/2021 | Surjaatmadja et al. | |
| 11,125,225 | B2 | 9/2021 | Beisel | |
| 11,268,502 | B2 | 3/2022 | Mollatt | |
| 11,286,920 | B2 | 3/2022 | Mollatt | |
| 11,346,336 | B2 | 5/2022 | Surjaatmadja et al. | |
| 11,401,792 | B2 | 8/2022 | Mollatt | |
| 11,415,123 | B2 | 8/2022 | Hunter et al. | |
| 2003/0031565 | A1 | 2/2003 | Kleibrink | |
| 2006/0008364 | A1 | 1/2006 | Traylor | |
| 2007/0065305 | A1 | 3/2007 | Budde et al. | |
| 2007/0074872 | A1 | 4/2007 | Du et al. | |
| 2008/0145248 | A1 | 6/2008 | Kato et al. | |
| 2009/0041588 | A1 | 2/2009 | Hunter et al. | |
| 2010/0014996 | A1 * | 1/2010 | Wilmsen | F04B 17/00 417/472 |
| 2012/0091165 | A1 | 4/2012 | Cedrone et al. | |
| 2012/0308409 | A1 | 12/2012 | Levine | |
| 2015/0148919 | A1 | 5/2015 | Watson | |
| 2016/0097384 | A1 | 4/2016 | Menjoh et al. | |
| 2016/0123313 | A1 * | 5/2016 | Simmons | F04B 9/133 417/392 |
| 2018/0313196 | A1 | 11/2018 | Frantz et al. | |
| 2019/0383279 | A1 | 12/2019 | Simmons et al. | |
| 2020/0217186 | A1 | 7/2020 | Mollatt | |
| 2020/0256333 | A1 | 8/2020 | Surjaatmadja et al. | |
| 2020/0277951 | A1 | 9/2020 | Hunter et al. | |
| 2020/0309113 | A1 | 10/2020 | Hunter et al. | |
| 2021/0140294 | A1 | 5/2021 | Mollatt | |
| 2021/0148354 | A1 | 5/2021 | Adams | |
| 2021/0173111 | A1 | 6/2021 | Therrien et al. | |
| 2021/0190065 | A1 | 6/2021 | Ferden et al. | |
| 2021/0246894 | A1 | 8/2021 | Mollatt | |
| 2022/0178368 | A1 | 6/2022 | Montilla Jimenez et al. | |
| 2024/0376809 | A1 | 11/2024 | Hurst et al. | |
| 2024/0376881 | A1 | 11/2024 | Hurst et al. | |
| 2024/0376887 | A1 | 11/2024 | Hurst et al. | |
| 2025/0163784 | A1 | 5/2025 | Clyburn et al. | |

FOREIGN PATENT DOCUMENTS

| | | | |
|---|---|---|---|
| CN | 106761573 | B | 4/2019 |
| DE | 596227 | C | 7/1934 |
| DE | 2253288 | A1 | 5/1974 |
| DE | 3706338 | A1 | 9/1988 |
| EP | 1602830 | A1 | 7/2005 |
| EP | 2913525 | A1 | 2/2015 |
| EP | 4286688 | A1 | 12/2021 |
| FR | 1441747 | A | 6/1966 |
| FR | 2367203 | A2 | 5/1978 |
| GB | 2185291 | A | 7/1987 |
| JP | 60-93190 | A * | 5/1985 |
| JP | 1-257775 | A * | 10/1989 |
| JP | H11159464 | A | 6/1999 |
| JP | 2006200464 | B2 | 8/2006 |
| JP | 2007100663 | A | 4/2007 |
| KR | 1020170016059 | A | 8/2018 |
| SU | 1359482 | A1 | 12/1987 |
| WO | 2015078487 | A1 | 6/2015 |
| WO | 2022099219 | A1 | 5/2022 |
| WO | 2022164034 | A1 | 8/2022 |

OTHER PUBLICATIONS

English Langauge Translation of JP 60-093190A, via J-Plat Pat. (Year: 1985).*

Foreign Communication from Related Application—International Search Report and Written Opinion of the International Searching Authority, International Application No. PCT/US2023/086404, dated Apr. 24, 2024, 10 pages.

Foreign Communication from Related Application—International Search Report and Written Opinion of the International Searching Authority, International Application No. PCT/US2023/086394, dated Apr. 24, 2024, 11 pages.

Foreign Communication from Related Application—International Search Report and Written Opinion of the International Searching Authority, International Application No. PCT/US2023/086395, dated Apr. 30, 2024, 11 pages.

Foreign Communication from Related Application—International Search Report and Written Opinion of the International Searching Authority, International Application No. PCT/US2023/086389, dated May 1, 2024, 11 pages.

Foreign Communication from Related Application—International Search Report and Written Opinion of the International Searching Authority, International Application No. PCT/US2023/086385, dated May 7, 2024, 11 pages.

Foreign Communication from Related Application—International Search Report and Written Opinion of the International Searching Authority, International Application No. PCT/US2023/086397, dated May 7, 2024, 10 pages.

Filing Receipt, Specification and Drawings for U.S. Appl. No. 18/398,878, filed Dec. 28, 2023, entitled "Direct Connect Piston-Driven Bellows Pump," 96 pages.

Filing Receipt, Specification and Drawings for U.S. Appl. No. 18/398,885, filed Dec. 28, 2023, entitled "Improved Cooling for Bellows Pump," 80 pages.

Filing Receipt, Specification and Drawings for U.S. Appl. No. 18/398,905, filed Dec. 28, 2023, entitled "Valve Monitoring System for a Bellows Pump," 91 pages.

(56) References Cited

OTHER PUBLICATIONS

Filing Receipt, Specification and Drawings for U.S. Appl. No. 18/398,923, filed Dec. 28, 2023, entitled "Active Bellows Pump Valve Management," 81 pages.
Filing Receipt, Specification and Drawings for U.S. Appl. No. 18/399,058, filed Dec. 28, 2023, entitled Protection of Make-Up System for High Pressure Bellows-Stylepump System, 91 pages.
Foreign Communication from Related Application—International Search Report and Written Opinion of the International Searching Authority, International Application No. PCT/US2023/086392, dated Apr. 19, 2024, 11 pages.
Filing Receipt, Specification and Drawings for U.S. Appl. No. 18/398,936, filed Dec. 28, 2023, entitled "Systems and Methods Using a Bellows Pump to Perform Operations for a Subterranean Formation," 81 pages.
First Office Action dated Apr. 28, 2025 (45 pages), U.S. Appl. No. 18/398,878, filed Dec. 28, 2023.
First Office Action dated Mar. 12, 2025 (8 pages), U.S. Appl. No. 18/398,936, filed Dec. 28, 2023.
First Office Action dated Jun. 2, 2025 (44 pages), U.S. Appl. No. 18/399,058, filed Dec. 28, 2023.
First Office Action dated Jun. 23, 2025 (47 pages), U.S. Appl. No. 18/398,885, filed Dec. 28, 2023.
First Office Action dated Jul. 2, 2025 (40pages) U.S. Appl. No. 18/398,905, filed Dec. 28, 2023.
First Office Action dated May 2, 2025 (28 pages) U.S. Appl. No. 18/398,923, filed Dec. 28, 2023.

* cited by examiner

BELLOWS FAILURE DETECTION FOR A PUMP

CROSS-REFERENCE TO RELATED APPLICATIONS

This application claims priority benefit under 35 U.S.C. 119(e) of U.S. Provisional Patent Application Ser. No. 63/501,980 (filed May 12, 2023), which is incorporated by reference herein in its entirety.

STATEMENT REGARDING FEDERALLY SPONSORED RESEARCH OR DEVELOPMENT

Not applicable.

FIELD

This disclosure relates generally to the field of pumping, for example pumping of fluids downhole in a well. More particularly, this disclosure relates to systems and methods relating to bellows pumps.

BACKGROUND

To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing the casing or liner into place. Once the wellbore is completed as desired (lined, cased, open hole, or any other known completion), treatment, such as a stimulation operation, may be performed to enhance hydrocarbon production into the wellbore. Examples of some common stimulation operations involve hydraulic fracturing, acidizing, fracture acidizing, and hydro-jetting. Stimulation operations are intended to increase the flow of hydrocarbons from the subterranean formation surrounding the wellbore into the wellbore itself so that the hydrocarbons may then be produced up to the wellhead.

One typical formation stimulation process may involve hydraulic fracturing of the formation and placement of a proppant in those fractures. Typically, a treatment/stimulation fluid (which may comprise a clean fluid and a proppant) may be mixed at the surface before being pumped downhole in order to induce fractures or perforations in the formation of interest. The creation of such fractures or perforations will increase the production of hydrocarbons by increasing the flow paths into the wellbore.

Various types of pumps have been used in well operations such as hydraulic fracturing. However, given the difficult conditions and related wear and reliability issues that may arise when pumping treatment fluids for a hydrocarbon well, there is need for improved pumps and related systems and methods.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

Disclosed embodiments illustrate exemplary systems and methods for using treatment fluids to carry out subterranean treatments in conjunction with a variety of subterranean operations, including but not limited to, hydraulic fracturing operations, fracturing acidizing operations to be followed with proppant hydraulic fracturing operations, stimulation treatments, drilling, cementing, and the like. For example, treatment fluid may be introduced into a wellbore (e.g. which penetrates a subterranean formation) at a pressure sufficient to create or enhance one or more fractures within the subterranean formation (for example, hydraulic fracturing) and/or to create or enhance and treat microfractures within a subterranean formation in fluid communication with a primary fracture in the formation. In one or more embodiments, the systems and methods of the present disclosure may be used to treat pre-existing fractures, or fractures created using a different treatment fluid. In one or more embodiment, a treatment fluid may be introduced at a pressure sufficient to create or enhance one or more fractures within the formation, and/or one or more of the treatment fluids may include a proppant material which subsequently may be introduced into the formation. In embodiments, treatment fluid can be any fluid (and may in some instances include solid particles therein) which can be pumped into a well. In embodiments, treatment fluid may differ from drive fluid used within a pump mechanism.

Figure 1:
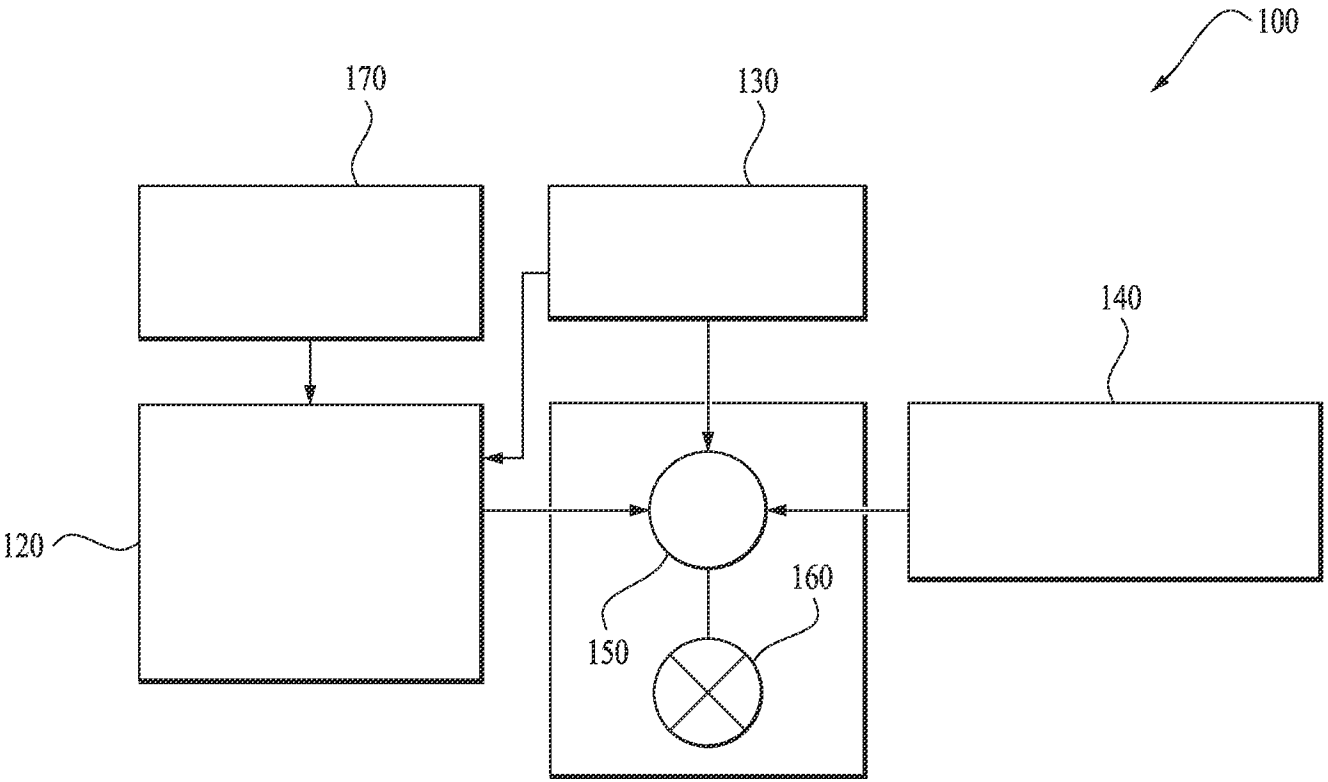
FIG. 1 is a schematic illustration of an exemplary well treatment system, such as an exemplary fracturing system, according to an embodiment of the disclosure.

By way of example, FIG. 1 schematically illustrates an exemplary fracturing system 100. The fracturing system 100 may be implemented using the systems, methods, and techniques described herein. In particular, the disclosed systems, methods, and techniques may directly or indirectly affect one or more components or pieces of equipment associated with the example fracturing system 100, according to one or more embodiments. In embodiments, the fracturing system 100 may comprise one or more of the following: a fracturing fluid producing apparatus 120, a fluid source 130, a solid source 140, an additive source 170, and a pump and blender system 150. All or an applicable combination of these components of the fracturing system 100 may reside at the surface at a well site/fracturing pad where a well 160 can be located.

During a fracturing job, the fracturing fluid producing apparatus 120 may access the fluid source 130 for introducing/controlling flow of a fluid, e.g. a treatment fluid such as fracturing fluid, in the fracturing system 10. While only a single fluid source 130 is shown, the fluid source 130 may include a plurality of separate fluid sources (e.g. storage tanks). In some embodiments, the fracturing fluid producing apparatus 120 may be omitted from the fracturing system 100, with the fracturing fluid instead being sourced directly from the fluid source 130 during a fracturing job rather than through the intermediary fracturing fluid producing apparatus 120.

The fracturing fluid may be an applicable fluid for forming fractures during a fracture stimulation treatment of the well 160. For example, the fracturing fluid may include water, a hydrocarbon fluid, a polymer gel, foam, air, wet gases, and/or other applicable fluids. In various embodiments, the fracturing fluid may include a concentrate to which additional fluid is added prior to use in a fracture stimulation of the well 160. In certain embodiments, the fracturing fluid may include a gel pre-cursor with fluid, e.g. liquid or substantially liquid, from fluid source 130. Accordingly, the gel pre-cursor with fluid may be mixed by the fracturing fluid producing apparatus 120 to produce a hydrated fracturing fluid for forming fractures.

The solid source 140 may include a volume of one or more solids which may be mixed with a fluid, e.g. the fracturing fluid, to form a solid-laden fluid. The solid-laden fluid may be pumped into the well 160 as part of a solid-laden fluid stream that is used to form and stabilize fractures in the well 160 during a fracturing job. The one or more solids within the solid source 140 may include applicable solids that may be added to the fracturing fluid of the fluid source 130. Specifically, the solid source 140 may contain one or more proppants for stabilizing fractures after they are formed during a fracturing job, e.g. after the fracturing fluid flows out of the formed fractures. For example, the solid source 140 may contain sand.

The fracturing system 100 may also include an additive source 170. The additive source 170 may contain/provide one or more applicable additives that may be mixed into fluid, e.g. the fracturing fluid, during a fracturing job. For example, the additive source 170 may include solid-suspension-assistance agents, gelling agents, weighting agents, and/or other optional additives to alter the properties of the fracturing fluid. The additives may be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives may function to maintain solid particle suspension in a mixture of solid particles and fracturing fluid as the mixture is pumped down the well 160 to one or more perforations.

The pump and blender system 150 functions to pump treatment fluid into the well 160. Specifically, the pump and blender system 150 of FIG. 1 may pump fracture fluid from the fluid source 130, e.g. fracture fluid that is received through the fracturing fluid producing apparatus 120, into the well 160 for forming and potentially stabilizing fractures as part of a fracture job. The pump and blender system 150 may include one or more pumps. Specifically, the pump and blender system 150 may include a plurality of pumps that may operate together, e.g. concurrently, to form fractures in a subterranean formation as part of a fracturing job. The one or more pumps included in the pump and blender system 150 may be any applicable type of fluid pump. For example, the pumps in the pump and blender system 150 may include electric pumps and/or hydrocarbon and hydrocarbon mixture powered pumps, such as diesel-powered pumps, natural gas-powered pumps, and diesel combined with natural gas-powered pumps. In one or more embodiments, one or more of the pumps in the pump and blender system 150 may be a bellows pump.

In some embodiments, the pump and blender system 150 may also function to receive the fracturing fluid and combine it with other components and solids (e.g. with the pump and blender system 150 optionally comprising a blender unit). Specifically, the pump and blender system 150 may combine the fracturing fluid with volumes of solid particles, e.g. proppant, from the solid source 140 and/or additional fluid and solids from the additive source 170. In turn, the pump and blender system 150 may pump the resulting mixture down the well 160 at a sufficient pumping rate to create or enhance one or more fractures in a subterranean zone, for example, to stimulate production of fluids from the zone. While the pump and blender system 150 is described to perform both pumping and mixing of fluids and/or solid particles, in various embodiments, the pump and blender system 150 may function to just pump a fluid stream, e.g. a treatment and/or fracture fluid stream, down the well 160 to create or enhance one or more fractures in a subterranean zone. In some embodiments, a separate pump and/or separate blender may be used (e.g. independently of each other or alone).

In embodiments, one or more elements/components of the system may be monitored (e.g. using one or more sensor). For example, the fracturing fluid producing apparatus 120, fluid source 130, and/or solid source 140 may be equipped with one or more monitoring devices (not shown). The monitoring devices may be used to control the flow of fluids, solids, and/or other compositions to the pumping and blender system 150. Such monitoring devices may effectively allow the pumping and blender system 150 to source from one, some, or all of the different sources at a given time. In turn, the pumping and blender system 150 may provide just fracturing fluid into the well 160 at some times, just solids or solid slurries at other times, and combinations of those components at other times.

Figure 2:
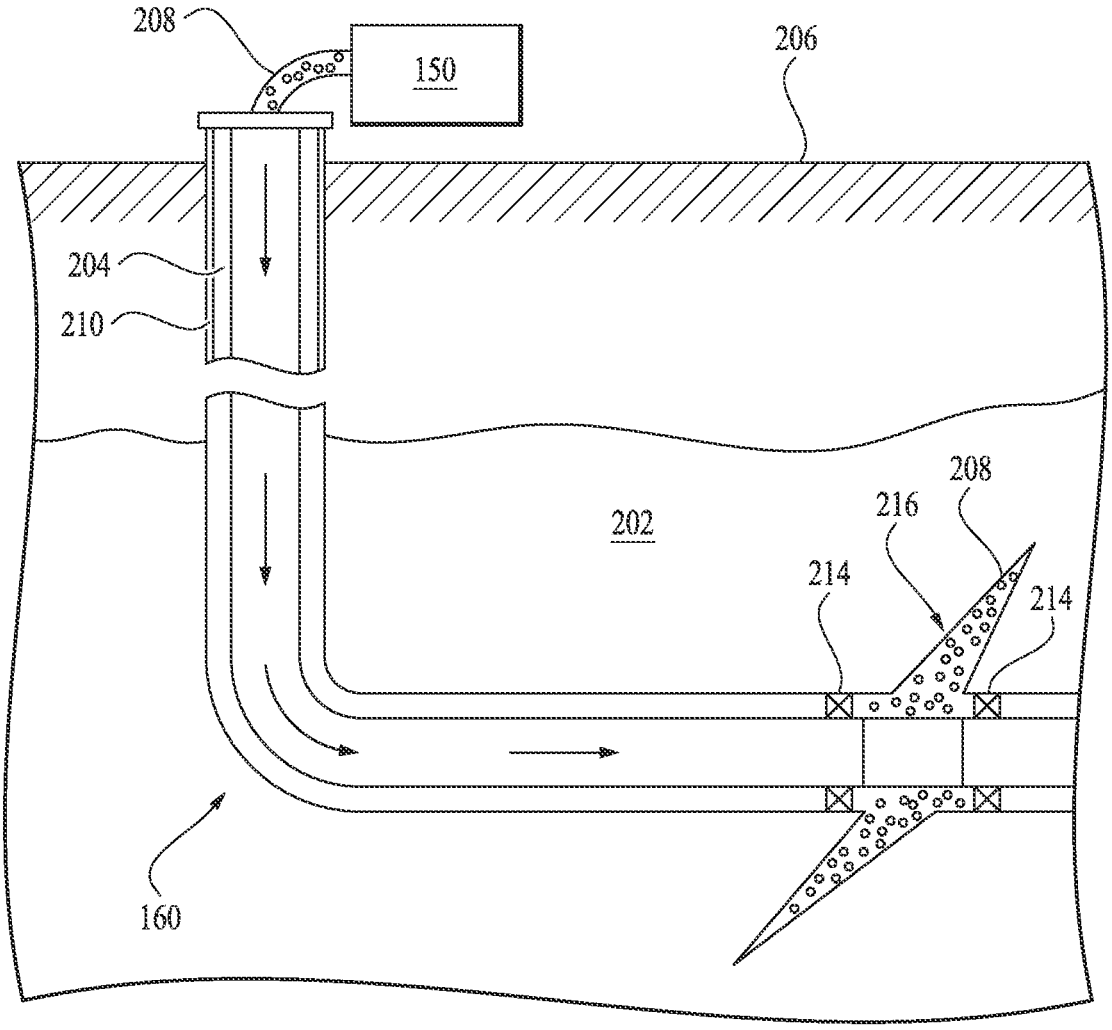
FIG. 2 is a schematic illustration of an exemplary well during a treatment operation, according to an embodiment of the disclosure.

FIG. 2 illustrates an exemplary well 160 during a treatment operation (e.g. a fracturing operation) in a portion of a subterranean formation of interest 202 surrounding a wellbore 204. In embodiments, the downhole operation may be performed using one or an applicable combination of the components in the example system 100 shown in FIG. 1. The wellbore 204 of FIG. 2 extends from a surface 206, and a fracturing fluid 208 is applied to a portion of the subterranean formation 202 (e.g. surrounding the horizontal portion of the wellbore 204). Although shown as vertical deviating to horizontal, the wellbore 204 may include horizontal, vertical, slant, curved, and other types of wellbore geometries and orientations, and the fracturing treatment may be applied to a subterranean zone surrounding any portion of the wellbore 204. The wellbore 204 may include a casing 210 that is cemented or otherwise secured to the wellbore wall. The wellbore 204 may be uncased or otherwise include uncased sections. Perforations may be formed in the casing 210 to allow fracturing fluids and/or other materials to flow into the subterranean formation 202. In the example fracture operation shown in FIG. 2, a perforation is created between points 214 (which may represent one or more packer element in some embodiments) defining an isolated zone.

The pump and blender system 150 (or in some embodiments, just a pump or a separate pump and a separate blender) may be fluidly coupled to the wellbore 204 to pump treatment fluid (e.g. fracturing fluid 208), and potentially other applicable solids and solutions, into the wellbore 204. When the fracturing fluid 208 is introduced into wellbore 204, it may flow through at least a portion of the wellbore 204 to the perforation, for example defined by points 214 in FIG. 2. The fracturing fluid 208 may be pumped at a sufficient pumping rate through at least a portion of the wellbore 204 to create one or more fractures 216 through the perforation and into the subterranean formation 202. Specifically, the fracturing fluid 208 may be pumped at a sufficient pumping rate to create a sufficient hydraulic pressure at the perforation to form the one or more fractures 216. Further, solid particles, e.g. proppant from the solid source 140, may be pumped into the wellbore 204, e.g. within the fracturing fluid 208 towards the perforation. In turn, the solid particles may enter the fractures 216 where they may remain after the fracturing fluid flows out of the wellbore. These solid particles may stabilize or otherwise "prop" the fractures 216, such that fluids may flow freely through the fractures 216.

While only two perforations at opposing sides of the wellbore 204 are shown in FIG. 2, greater than two perforations may be formed in the wellbore 204 as part of a perforation cluster. Fractures may then be formed through the plurality of perforations in the perforation cluster as part of a fracturing stage for the perforation cluster. Specifically, fracturing fluid and solid particles may be pumped into the wellbore 204 and pass through the plurality of perforations during the fracturing stage to form and stabilize the fractures through the plurality of perforations.

The pump and blender system 150 may comprise a pump, which may be used, either alone or in combination with one or more other pumps, to pressurize a treatment fluid and/or introduce the treatment fluid into wellbore 204 penetrating at least a portion of a subterranean formation to perform a treatment therein. For example, in hydraulic fracturing operations, one or more pumps may be used to pump a treatment fluid (e.g. fracturing fluid 208, which typically may be a slurry mixture of proppant and/or sand mixed with water) into the formation.

Figure 3:
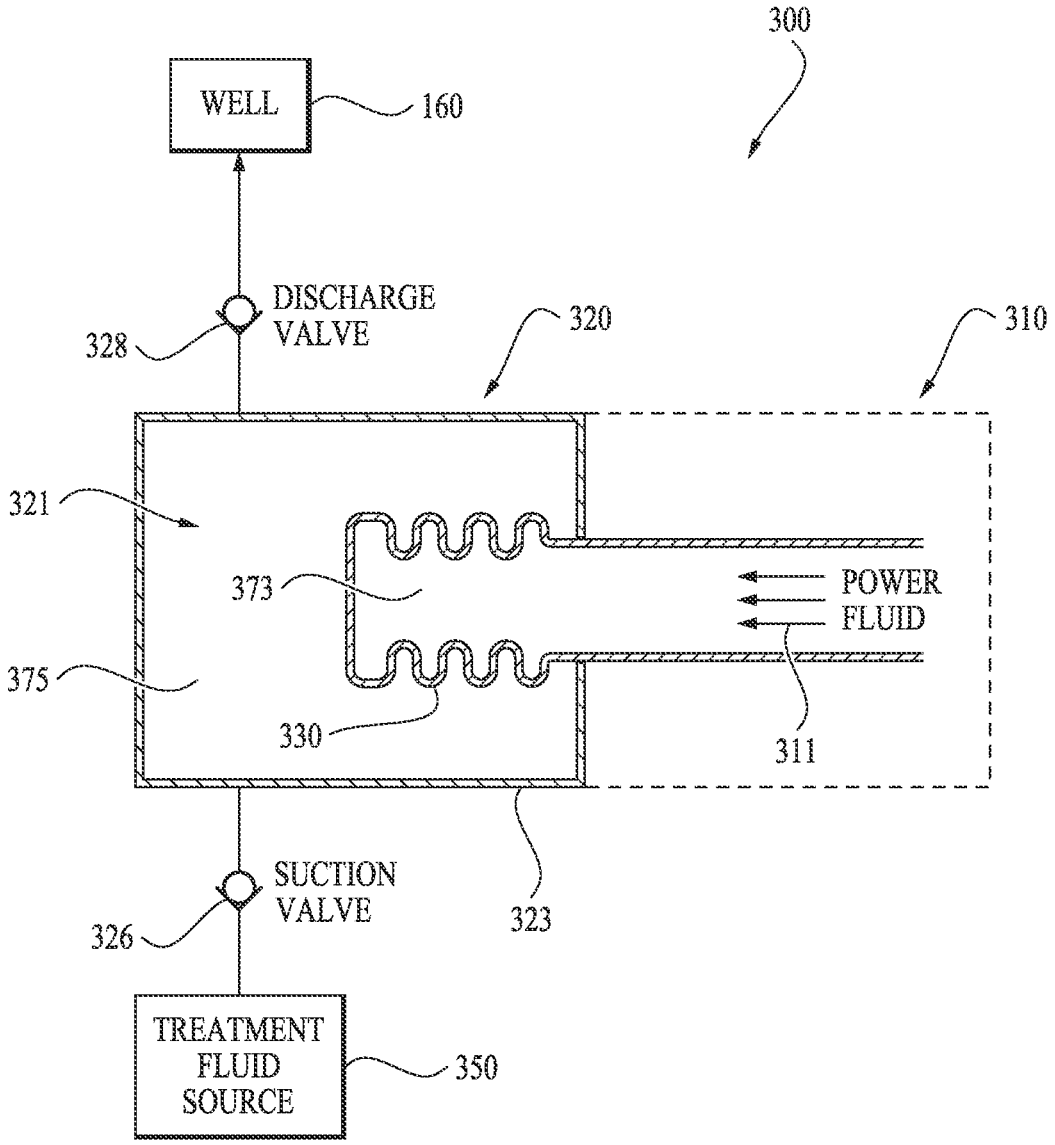
FIG. 3 is a schematic illustration of an exemplary bellows pump, according to an embodiment of the disclosure.

In some embodiments, the pump may comprise a bellows pump 300, which may be configured to segregate treatment fluid from drive fluid (sometimes termed power fluid). See for example FIG. 3, which schematically illustrates a bellows pump 300. The bellows pump 300 may comprise a power end 310, a fluid end 320, and an expandable bellows 330. The fluid end 320 may have a chamber 321 within a fluid end housing 323, a suction valve 326 in fluid communication with (e.g. fluidly coupled to) the chamber 321 and a source/reservoir for the treatment fluid 350 (e.g. with the suction valve 326 being configured to allow for insertion of treatment fluid into the chamber 321), and a discharge valve 328 in fluid communication with (e.g. fluidly coupled to) the chamber 321 and the well (e.g. with the discharge valve 328 being configured to allow for insertion of treatment fluid from the chamber 321 into the well or any other place where treatment fluid is intended to be pumped). While the suction valve 326 and discharge valve 328 may be disposed within the housing 323 for the fluid end 320 in some embodiments, in other embodiments, the suction valve 326 and discharge valve 328 may be located within other components (such as piping) that fluidly couples the valves to the elements/components of the pump 300 as described.

In embodiment, the power end 310 may be fluidly connected to (e.g. in fluid communication with) the bellows 330 (e.g. the inner volume of the bellows) and/or configured to reciprocally expand/inflate and contract/deflate the bellows 330 based on movement of drive fluid 311 (sometimes termed power fluid). The bellows 330 may be configured to reciprocally expand and/or retract within the chamber 321 of the fluid end 320 based on movement of the drive fluid 311. In some embodiments, the bellows 330 may be sealingly coupled to an opening in the chamber 321 of the fluid end 320 (e.g. coupled to the wall of the chamber), so that fluid communication between the power end 310 and the bellows 330 causes reciprocal movement of the bellows 330 within the chamber 321. In some embodiments, the power end 310 may be (e.g. sealingly) coupled to the fluid end 320, with no flow of treatment fluid or drive fluid therebetween (e.g. since the bellows 330 separates the fluids).

In embodiments, the bellows 330 may comprise a flexible/expandable bag or body, typically of thin, flexible material, whose inner volume (e.g. the open space therein, which may be configured to hold drive fluid) can be changed (e.g. based on the amount/pressure of fluid therein). The bellows 330 may have an opening allowing fluid communication of drive fluid 311 with the power end 310, but in some embodiments may otherwise have a form configured to retain fluid therein. For example, the bellows 330 may be configured to prevent fluid transfer between its interior and the chamber 321 of the fluid end 320 external to the bellows 330. In some embodiments, the bellows 330 may comprise an elastomeric element and/or material. In some embodiments, the bellows 330 may comprise metal material and/or may include an accordion-like configuration (e.g. having pleats or folds or convolutions). In some embodiments, exemplary metal bellows may be formed of a metal that is sufficiently flexible and/or durable and configured appropriately to effectively withstand repeated back and forth motion due to reciprocal movement without breaking or wearing to failure for a reasonable life of the bellows. For example, the bellows may comprise stainless steel, nickel alloys such as Inconel & Monel, hastealloy, and/or copper alloys. In some embodiments, the bellows 330 may not be configured to withstand significant pressure differentials. In some embodiments, the bellows 330 may be configured to separate (e.g. isolate) drive fluid 311 (e.g. clean fluid) from treatment fluid (e.g. dirty fluid, such as fluid having proppant, abrasives, and/or corrosive materials, such as from treatment fluid source 350).

The bellows 330 may be disposed in and/or configured to expand into the chamber 321 of the fluid end 320, and may be configured to serve as a separating barrier that divides the chamber 321 into a first volume 373 within the bellows 330 and a second volume 375 outside of the bellows 330. The first volume 373 (e.g. inner volume of the bellows 330) may be in fluid communication with the power end 310, and may in some embodiments contain drive fluid. The second volume 375 of the chamber 321 is in fluid communication with the suction valve 326 and discharge valve 328, and is configured for treatment fluid to flow therethrough. The bellows 330 may serve as a fluid separating barrier between the drive fluid 311 in the first volume 373 and the treatment fluid in the second volume 375. The bellows 330 may be configured to flex (e.g. expand and/or contract) to balance pressure between the first volume 373 and second volume 375 during operation of the pump 300. In some embodiments, the bellows 330 may be configured to flex axially. The power end 310 of pump 300 may be sealingly connected to the fluid end 320, to prevent entry of treatment fluid from the fluid end 320 into the power end 310.

The chamber 321 may be downstream of the fluid treatment source 350 and upstream of the well 160. Typically, the suction valve 326 can be a one-way check valve configured to allow treatment fluid from the treatment fluid source 350 to enter the chamber 321 (e.g. during a suction stroke of the pump 300), and the discharge valve 328 can be a one-way check valve configured to allow treatment fluid to exit the chamber 321 towards the well (e.g. during a power/discharge stroke of the pump 300). The reciprocating expansion and retraction of the bellows 330 in the chamber 321 (e.g. with the bellows 330 expanding/inflating for the discharge stroke and contracting/deflating for the suction stroke) can be configured to work in conjunction with the suction valve 326 and discharge valve 328 to allow the fluid end 320 to pump treatment fluid into the well 160. For example, during a discharge stroke, as drive fluid 311 enters the first volume 373 (e.g. the inner volume of the bellows 330), the bellows 330 inflates and treatment fluid is expelled from the second volume 375 of the chamber 321 through the discharge valve 328. Once the discharge stroke is complete, a suction stroke can begin. During the suction stroke, drive fluid 311 inside the first volume 373 exits the bellows 330, the bellows 330 deflates, and treatment fluid can be drawn through the suction valve 326 into the second volume 375 of the chamber 321. Once the bellows 330 is compressed to its minimum desired/permitted length, another discharge stroke can begin.

The bellows 330 may be configured to separate treatment fluid, which the pump 300 may be pumping into the well 160, from drive fluid 311 used for pump operations. By way of example, the drive fluid 311 may be chosen from a desirable group of liquids, which may include hydraulic fluid such as water or hydraulic oil. In some embodiments, the drive fluid 311 may also serve as a lubricant for the pump 300, for example forming a barrier against wear due to friction. In the case of a fracturing operation or a fracturing pump, the treatment fluid may be a fracturing fluid that may comprise a base fluid (e.g., water, oils, organic liquids, etc.) as well as any other suitable components or additives useful for the fracturing treatment. For example, the fracturing fluid may be a slurry containing sand or synthetic proppants and/or a variety of chemical additives such as gelling agents, acids, friction reducers, and solvents.

In various embodiments, any mechanism for causing reciprocal movement of the bellows 330 (e.g. by movement of the drive fluid 311) can provide the pumping action for the pump 300. In some embodiments, the power end 310 may further comprise a piston or plunger 410 configured to reciprocally move drive fluid 311 (e.g. in and out of the bellows 330). See for example FIG. 4, which schematically illustrates an embodiment of the bellows pump 300 having a piston/plunger 410. Reciprocal movement (e.g. axial translation) of the piston/plunger 410 within a bore 420 of the power end housing 413 may cause the reciprocal movement (e.g. expanding and contracting) of the bellows 330 (e.g. within the chamber 321 of the fluid end 320), for example with the piston/plunger 410 displacing fluid (e.g. hydraulic drive fluid 311) which is located in the bore 420 between the driven end of the piston/plunger 410 (e.g. the end in proximity to the bellows 330) and the bellows 330. Since the bore 420 is fluidly coupled to (e.g. in fluid communication with) the bellows 330, the piston/plunger 410 reciprocally displacing drive fluid 311 can induce reciprocal movement (e.g. expansion and contraction) of the bellows 330. As used herein, reference to "piston" shall include both conventional piston and plunger elements for convenience of reference.

Figure 4:
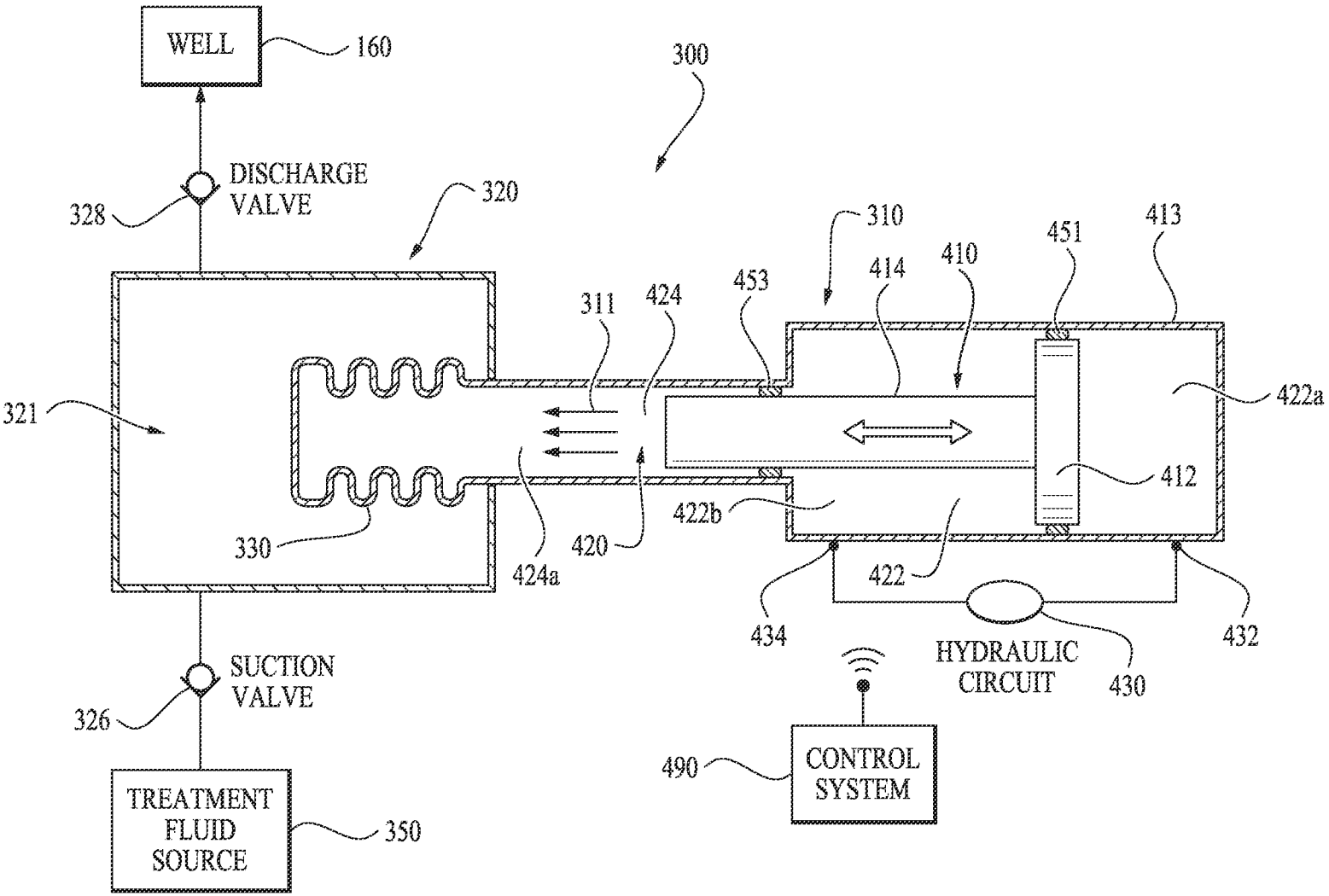
FIG. 4 is a schematic illustration of an exemplary bellows pump with piston/plunger, according to an embodiment of the disclosure.

In embodiments, the piston 410 may be configured to sealingly move within the bore 420, for example having one or more seal (configured to engage between the piston 410 and the bore 420) disposed on the piston 410 and/or on the inner wall of the bore 420. In some embodiments, one or more seal may comprise pump packing. In some embodiments, the bellows 330 may be configured to protect the piston 410 from wear, for example by separating the piston 410 from the treatment fluid in the fluid end 320. In some embodiments, the piston 410 may be configured so that, during its reciprocal movement in the bore 420, the piston 410 does not extend into the inner volume of the bellows 330; while in other embodiments, the piston 410 may be configured to extend partially into the bellows during a discharge stroke. Regardless, the piston 410 may be configured to not contact the bellows 330 (e.g. the end of the bellows) during its reciprocal movement. The piston 410 can be driven/powered by any suitable means, including various types of driver elements configured to induce reciprocal movement of the piston 410, such as a hydraulic circuit, a combustion engine, an electric motor, a linear actuator, rack and pinion, etc. In the example of FIG. 4, the piston 410 may be driven by a hydraulic circuit 430. In other exemplary embodiments, the pump 300 may be powered by natural gas (e.g. via a natural gas-fired engine or natural gas-fired electric generator) produced from the same area in which well treatment (e.g. fracturing) operations are being performed. In some embodiments, a control system 490 may control one or more aspect of the driver (e.g. to control the reciprocation of the piston 410 and thereby the bellows 330) and/or the valves (e.g. 326, 328).

In some embodiments, the piston 410 can comprise a head 412 and a rod 414 (e.g. with the rod 414 disposed between the head 412 and the bellows 330, and extending from the head 412 towards the fluid end 320). In some embodiments, the piston 410 can be driven by a hydraulic circuit 430. For example, the hydraulic circuit 430 of the power end 310 can include a first port 432, located such that the head 412 is disposed between the first port 432 and the rod 414, and a second port 434 located between the head 412 and the bellows 330 (e.g. more proximate the bellows 330 than the first port 432). In some embodiments, the hydraulic circuit 430 may include one or more source of drive fluid and/or one or more pump. For example, the first port 432 may be in fluid communication with a source of drive fluid and/or a pumping mechanism. In some embodiments, the second port 434 may be in fluid communication with a source of drive fluid and/or a pumping mechanism. In some embodiments, the source of drive fluid may be the same for the first port 432 and the second port 434. In some embodiments, the pumping mechanism may be the same for the first port 432 and the second port 434. In some embodiments, the hydraulic circuit 430 may include one or more valve. The hydraulic circuit 430 may be configured to produce pressure differential on either side of the piston 410 (e.g. the head 412), for example by introducing drive fluid (such as hydraulic oil) via the ports (432, 434), which may induce movement/displacement of the piston 410. For example, introducing drive fluid via the first port 432 and/or removing drive fluid via the second port 434 may urge extension of the piston 410 towards the fluid end 320, while introducing drive fluid via the second port 434 and/or removing drive fluid via the first port 432 may retract the piston 410, urging the piston 410 away from the fluid end 320.

While the rod 414 and head 412 may have a similar diameter in some embodiments, in some embodiments the rod 414 may have a smaller diameter than the head 412. The ratio of size differential between the rod 414 and the head 412 can provide an intensifying effect, in which pressure applied to the head 412 is multiplied/increased as applied to the bellows 330 (via the rod 414). For example, the piston 410 may be part of an intensifier configured to intensify applied pressure (e.g. from the driver) to the bellows 330 (e.g. with the rod 414 having a smaller diameter than the head 412). For example, the size difference/ratio between the diameter of the rod 414 and the head 412 may range from approximately 1:1.1 to 1:10 (e.g. from 1:1.5 to 1:10, from 1:2 to 1:10, from 1:3 to 1:10, from 1:5 to 1:10, from 1:7 to 1:10, from 1:1.5 to 1:8, from 1:1.5 to 1:5, from 1:1.5 to 1:3, from 1:2 to 1:8, from 1:2 to 1:5, from 1:2 to 1:3, from 1:3 to 1:10, from 1:3 to 1:8, or from 1:3 to 1:5).

As described above, the power end 310 may include a bore 420 (e.g. in a power end housing 413) in fluid communication with (e.g. fluidly coupled to) the bellows 330 (e.g. an internal volume of the bellows), and the piston 410 can be disposed within the bore 420. In embodiments (e.g. in which the piston 410 is not uniform in diameter along its length), the bore 420 may have a first portion 422 with an inner diameter configured for movement of the head 412 (axially) therethrough and a second portion 424 with an inner diameter configured for movement of the rod 414 (axially) therethrough. For example, the first portion 422 of the bore may have a diameter approximately equal to that of the head 412, while the second portion 424 of the bore may have a diameter approximately equal to that of the rod 414 (e.g. the first portion 422 of the bore may have a larger diameter than the second portion 424 of the bore). In embodiments, the head 412 may separate the first portion 422 of the bore 420 into two cavities (whose volumes may change based on the position of the head 412 within the bore 420), for example with a first cavity 422*a* distally away from the fluid end 320 and/or bellows 330 (e.g. with the head 412 disposed between the first cavity 422*a* and the bellows 330) and a second cavity 422*b* more proximal to the bellows 330 and/or fluid end 320 (e.g. with the second cavity 422*b* disposed between the head 412 and the bellows 330). Interaction of the rod 414 within the second portion 424 of the bore 420 may form a third cavity 424*a* in fluid communication with the bellows 330. In embodiments having a hydraulic circuit as the driver (e.g. as shown in FIG. 4), the first port 432 may be in fluid communication with the first cavity 422*a*, and the second port 434 may be in fluid communication with the second cavity 422*b*. The third cavity 424*a* may be in fluid communication with the bellows 330. Typically, the bore 420 may extend along the longitudinal axis of the power end 310 and/or parallel to the longitudinal axis (e.g. the axis of extension) of the bellows 330.

In operation, the head 412 of the piston 410 may be configured to sealingly move within the first portion 422 of the bore 410 (e.g. during pump strokes), and the rod 414 may be configured to sealingly move within the second portion 424 of the bore 420 (e.g. during pump strokes). In embodiments, the power end 310 may further comprise a first seal 451 configured to seal the head 412 with respect to the first portion 422 of the bore 420 (e.g. such that the head 412 and first seal 451 isolate the first cavity 422*a* from the second cavity 422*b*) and a second seal 453 configured to seal the rod 414 with respect to the second portion 424 of the bore 420 (e.g. such that the rod 414 and second seal 453 isolate the third cavity 424*a* from the second cavity 422*b*). For example, the first seal 451 may be disposed on the head 412 (e.g. a moving seal), such as within one or more groove configured to hold a gasket, or on the bore first portion 422 inner surface (e.g. a stationary seal) and/or the second seal 453 may be disposed on the rod 414 (e.g. a moving seal) or on the bore second portion 424 inner surface (a stationary seal). In some embodiments, the first seal 451 may be a moving seal (e.g. disposed on the head 412) and the second seal 453 may be a stationary seal (e.g. disposed on the inner surface/wall of the bore 420—e.g. within the bore second portion 424—which may in some embodiments comprises pump packing). In some embodiments, one or more stationary seal may be configured to prevent fluid flow between the second portion 424 of the bore and the first portion 422 of the bore and/or to provide a controlled volume of fluid for interaction with the inner volume of the bellows 330. While the discussion has been set forth with regard to a pump 300 having a single bellows 330, similar concepts apply for dual (e.g. double-acting) bellows pumps (e.g. in which a single piston interacts with two bellows, for example such that the discharge stroke for one bellows is the suction stroke for the other).

It can be important for the health of the bellows pump 300 (e.g. to protect the bellows 330 from excessive pressure differentials which could damage the bellows 330) to ensure that the bellows 330 and the piston 410 remain in sync (e.g. with the bellows 330 not exceeding its full permissible extension position when the piston 410 is at its maximum extension at the end of the discharge stroke, and the bellows 330 not exceeding its permissible contraction position when the piston 410 is at its most retracted position at the end of its suction stroke). To aid in maintaining such synchronization between the bellows 330 and the piston 410, the volume of fluid between the rod 414 and the bellows 330 may be maintained at approximately a constant volume. Leaks in the bellows 330 can prove problematic, affecting the amount of sync and potentially damaging the bellows 330. For example, a bellows 330 leak can cause a pressure imbalance between the drive fluid in the bellows 330 and the treatment fluid in the chamber 321, which may damage (e.g. crush) the bellows 330.

Figure 5:
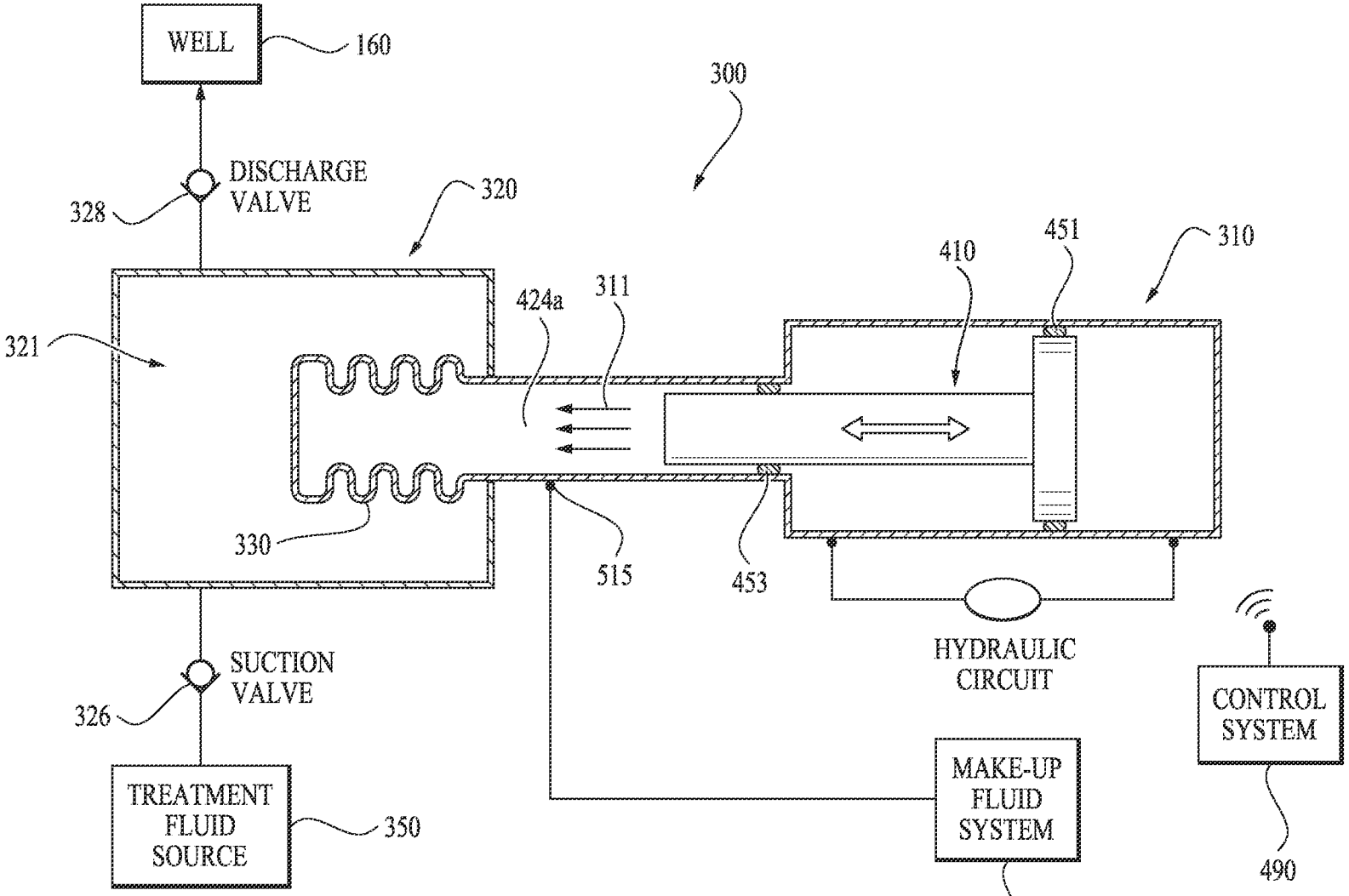
FIG. 5 is a schematic illustration of an exemplary system for providing make-up fluid to an exemplary bellows pump, according to an embodiment of the disclosure.

In order to address any such leak, a make-up system 510 (e.g. as shown schematically with an embodiment of pump 300 in FIG. 5) can be configured to correct/maintain a controlled volume of fluid in the space between the rod 414 and the bellows 330 (for example by injecting make-up fluid, which typically is drive fluid, into the space between the rod 414 and the bellows 330—e.g. into the controlled volume formed by the rod seal 453, such as the third cavity 424*a*), in order to maintain synchronization between the bellows 330 and the piston 410. For example, the power end 310 may include a make-up port 515 (e.g. a third port), which may be in fluid communication with the second portion 424 of the bore 420 (e.g. the third cavity 424*a* between the rod 414 and/or rod seal 453 and the bellows 330). While the make-up port 515 is shown with respect to the power end 310 in FIG. 5, in other embodiments, the make-up port 515 may be disposed in the fluid end 320.

A source of make-up fluid may be in fluid communication with the make-up port 515, and the make-up system 510 may further comprise one or more make-up valve configured to open (to provide fluid communication therethrough) and close (to prevent fluid communication therethrough and/or isolate the make-up system 510 from the bellows 330). In some embodiments the make-up system 510 may include a make-up pump, which may be configured to pump make-up fluid from the make-up fluid source into the second portion 424 of the bore 420 through the make-up port 515. The control system 490 in some embodiments may be used to operate the make-up system 510, for example opening and closing the make-up valve and/or operating the make-up pump. In some embodiments, the control system 490 may comprise and/or communicate with one or more sensors, whose data the control system 490 can use to determine if the bellows 330 and piston 410 are out of sync and to operate the make-up system 510 to bring the bellows 330 and piston 410 back into sync. For example, the control system 490 may open the make-up valve and activate the make-up pump to inject make-up fluid into cavity 424*a* and/or to draw make-up fluid out of cavity 424*a* via make-up port 515, in order to bring the bellows 330 and the piston 410 back into sync.

In some embodiments, the pump 300 may be one of a plurality of similar pumps which may be configured to operate together/concurrently (e.g. configured to jointly pump fluid in the well 160 and/or which are jointly driven and/or which share a common drive fluid source and/or make-up fluid source and/or which are jointly controlled). For example, the plurality of pumps 330 may share a common source for treatment fluid, drive fluid, and/or make-up fluid. In some embodiments, the drive fluid and the make-up fluid may be drawn from a common fluid source (e.g. drive fluid and make-up fluid may be substantially the same). In some embodiments, the plurality of pumps 330 can share a common driver. In some embodiments, the plurality of pumps 330 may share a common control system 490. In some embodiments, one or more of the plurality of pumps 330 may be configured to be out-of-sync with one or more other of the plurality of pumps 330 (for example with a first pump undergoing a discharge stroke while a second pump undergoes a suction stroke). In some embodiments, having pumps of the plurality of pumps 330 out-of-sync with each other may allow for continuous pumping of treatment fluid (e.g. under approximately constant pressure). In some embodiments, a first half of the plurality of pumps may be in sync with each other, while a second half of the plurality of pumps may be in sync with each other but out of sync with the first half. In some embodiments, the plurality of pumps may comprise at least two dissimilar pumps.

Some embodiments may include a control system 490, which may be configured to monitor and/or control one or more aspects of the bellows pump 300 and/or related treatment system 100 (e.g. a system including at least one bellows pump 300). The control system 490 may include an information handling system (e.g. comprising one or more processor) and/or may be configured to receive data from one or more sensor configured to monitor/detect one or more parameters of the system. In some embodiments, the parameters monitored may include pressure, temperature, flow rate, viscosity, contamination/particle count, strain, valve position, piston position, and/or bellows position. Data from the sensor(s) may be transmitted to and/or received by the information handling system, for example with the control system 490 using the data to monitor and/or control one or more aspect of the bellows pump 300 and/or system 100. In embodiments, the control system 490 may be configured to communicate with sensors and/or other components of the pump or system wirelessly and/or via wired connection.

Figure 6:
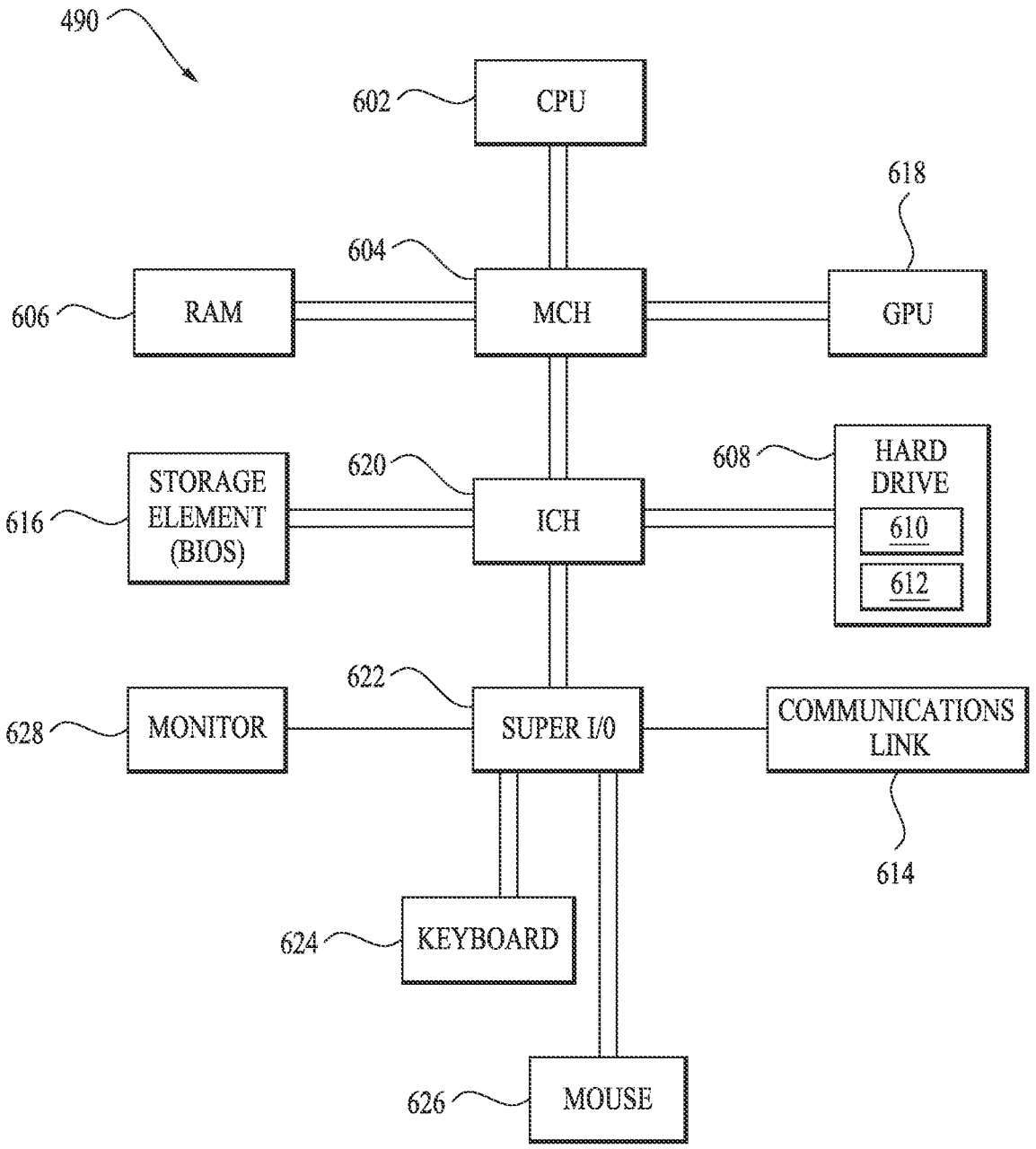
FIG. 6 is a schematic illustration of an exemplary control system, which may be used in conjunction with a bellows pump system, according to an embodiment of the disclosure.

FIG. 6 is a schematic diagram illustrating an exemplary information handling system/control system 490, for example for use with or by an associated treatment system 100 of FIG. 1, according to one or more aspects of the present disclosure. A processor or central processing unit (CPU) 602 of the control system 490 is communicatively coupled to a memory controller hub (MCH) or north bridge 604. The processor 602 may include, for example a microprocessor, microcontroller, digital signal processor (DSP), application specific integrated circuit (ASIC), or any other digital or analog circuitry configured to interpret and/or execute program instructions and/or process data. Processor 602 may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory 606 or hard drive 608. Program instructions or other data may constitute portions of a software or application, for example application 610 or data 612, for carrying out one or more methods described herein. Memory 606 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 610 or data 612 may be retrieved and stored in memory 606 for execution or use by processor 602. In one or more embodiments, the memory 606 or the hard drive 608 may include or comprise one or more non-transitory executable instructions that, when executed by the processor 602, cause the processor 602 to perform or initiate one or more operations or steps. The information handling system 600 may be preprogrammed or it may be programmed (and reprogrammed) by loading a program from another source (for example, from a CD-ROM, from another computer device through a data network, or in another manner).

The data 612 may include treatment data, geological data, fracture data, microseismic data, sensor data, or any other appropriate data. In one or more embodiments, the data 612 may include treatment data relating to fracture treatment plans. For example, the treatment data may indicate a pumping schedule, parameters of a previous injection treatment, parameters of a future injection treatment, or one or more parameters of a proposed injection treatment. Such one or more treatment parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 612 may include geological data relating to one or more geological properties of the subterranean formation 202 (referring to FIG. 2). For example, the geological data may include information on the wellbore 204 (referring to FIG. 2), completions, or information on other attributes of the subterranean formation 202. In one or more embodiments, the geological data may include information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, microseismic imaging, or other data sources. In one or more embodiments, the data 612 may include fracture data relating to fractures in the subterranean formation 202. The fracture data may identify the locations, sizes, shapes, and other properties of fractures in a model of a subterranean zone. The fracture data may include information on natural fractures, hydraulically-induced fractures, or any other type of discontinuity in the subterranean formation 202. The fracture data may include fracture planes calculated from microseismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information.

In embodiments, the sensor data may include data measured/detected by one or more sensors, for example with relation to one or more aspect of the pump 300 and/or the system 100. For example, the sensor data may include pressure (e.g. at the fluid end 320 and/or the power end 310), temperature (e.g. at the fluid end 320 and/or power end 310 and/or make-up system 510), flow rate (e.g. within the fluid end 310 and/or hydraulic circuit 430 and/or the make-up system 510), viscosity (e.g. of treatment fluid in the fluid end 320 and/or drive fluid in the power end 310), contamination/particle count (e.g. at the fluid end 320 and/or power end 310 and/or in the make-up system 510), strain (e.g. at the fluid end 320 and/or power end 310), suction valve 326 and/or discharge valve 328 position, piston position, and/or bellows position. Data received by the control system 490 (e.g. from one or more sensors) may be used to carry out operations with respect to the pump 300 and/or system 100. For example, the control system 490 may evaluate the data and determine one or more action based on the evaluation. In some embodiments, the control system 490 may automatically take action based on the evaluation.

The one or more applications 610 may comprise one or more software applications, one or more scripts, one or more programs, one or more functions, one or more executables, or one or more other modules that are interpreted or executed by the processor 602. For example, the one or more applications 610 may include a fracture design module, a reservoir simulation tool, a hydraulic fracture simulation model, or any other appropriate function block. The one or more applications 610 may include machine-readable instructions for performing one or more of the operations related to any one or more embodiments of the present disclosure. The one or more applications 610 may include machine-readable instructions for generating a user interface or a plot, for example, illustrating fracture geometry (for example, length, width, spacing, orientation, etc.), pressure plot, hydrocarbon production performance, pump performance. The one or more applications 610 may obtain input data, such as treatment data, geological data, fracture data, or other types of input data, from the memory 606, from another local source, or from one or more remote sources (for example, via the one or more communication links 614). The one or more applications 610 may generate output data and store the output data in the memory 606, hard drive 608, in another local medium, or in one or more remote devices (for example, by sending the output data via the communication link 614).

Memory controller hub 604 may include a memory controller for directing information to or from various system memory components within the information handling system 600, such as memory 606, storage element 616, and hard drive 608. The memory controller hub 604 may be coupled to memory 606 and a graphics processing unit (GPU) 618. Memory controller hub 604 may also be coupled to an I/O controller hub (ICH) or south bridge 620. I/O controller hub 620 is coupled to storage elements of the information handling system 600, including a storage element 616, which may comprise a flash ROM that includes a basic input/output system (BIOS) of the computer system. I/O controller hub 620 is also coupled to the hard drive 608 of the information handling system 600. I/O controller hub 320 may also be coupled to an I/O chip or interface, for example, a Super I/O chip 622, which is itself coupled to several of the I/O ports of the computer system, including a keyboard 624, a mouse 626, a monitor (or other display) 628 and one or more communications link 614. Any one or more input/output devices receive and transmit data in analog or digital form over one or more communication links 614 such as a serial link, a wireless link (for example, infrared, radio frequency, or others), a parallel link, or another type of link. The one or more communication links 614 may comprise any type of communication channel, connector, data communication network, or other link. For example, the one or more communication links 614 may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to FIG. 6 without departing from the scope of the present disclosure. For example, FIG. 6 shows a particular configuration of components of control system 490. However, any suitable configurations of components may be used. For example, components of control system 490 may be implemented either as physical or logical components. Furthermore, in some embodiments, functionality associated with components of control system 490 may be implemented in special purpose circuits or components. In other embodiments, functionality associated with components of control system 490 may be implemented in configurable general-purpose circuit or components. For example, components of control system 490 may be implemented by configured computer program instructions.

In a bellows-style pump, detecting leakage with respect to the bellows can be important, for example for pump durability and life. Bellows-style pumps may be prone to fatigue failure or mechanical or hydraulic damage, for example due to high-pressure drive fluid that expands the bellows and which, over time, may result in damage or wear of the bellows in the bellows pump. Such damage or wear of the bellows may allow the high-pressure pumped treatment fluid to leak through the barrier provided by the bellows, potentially entering the bellows and thereby causing contamination of the drive fluid of the power end of the bellows pump (which could, in turn, cause further damage to the pump). Additionally, such damage or wear of the bellows may allow drive fluid to leak out of the bellows, escaping containment and potentially causing damage to the bellows during pumping operations due to resulting pressure imbalances in the pump. Early and effective leakage detection can prevent costly damage.

The disclosed embodiments may provide mechanisms for sensing, detecting, and/or monitoring this type of issue (e.g. leakage with respect to the bellows, which may be indicative of wear and/or damage to the bellows), which may be used to dynamically and/or in real time indicate the wearing of the bellows. Disclosed embodiments may relate to a bellows pump system in which the bellows is configured to form an annulus, such that fluid in the annulus may be monitored in order to detect leakage. For example, a double-walled bellows may include an annulus between the walls, and the annulus may be in fluid communication with a port. Detection of fluid at the port may be indicative of leakage (either into or out of the bellows), and one or more action may be taken in response to such fluid detection.

Figure 7:
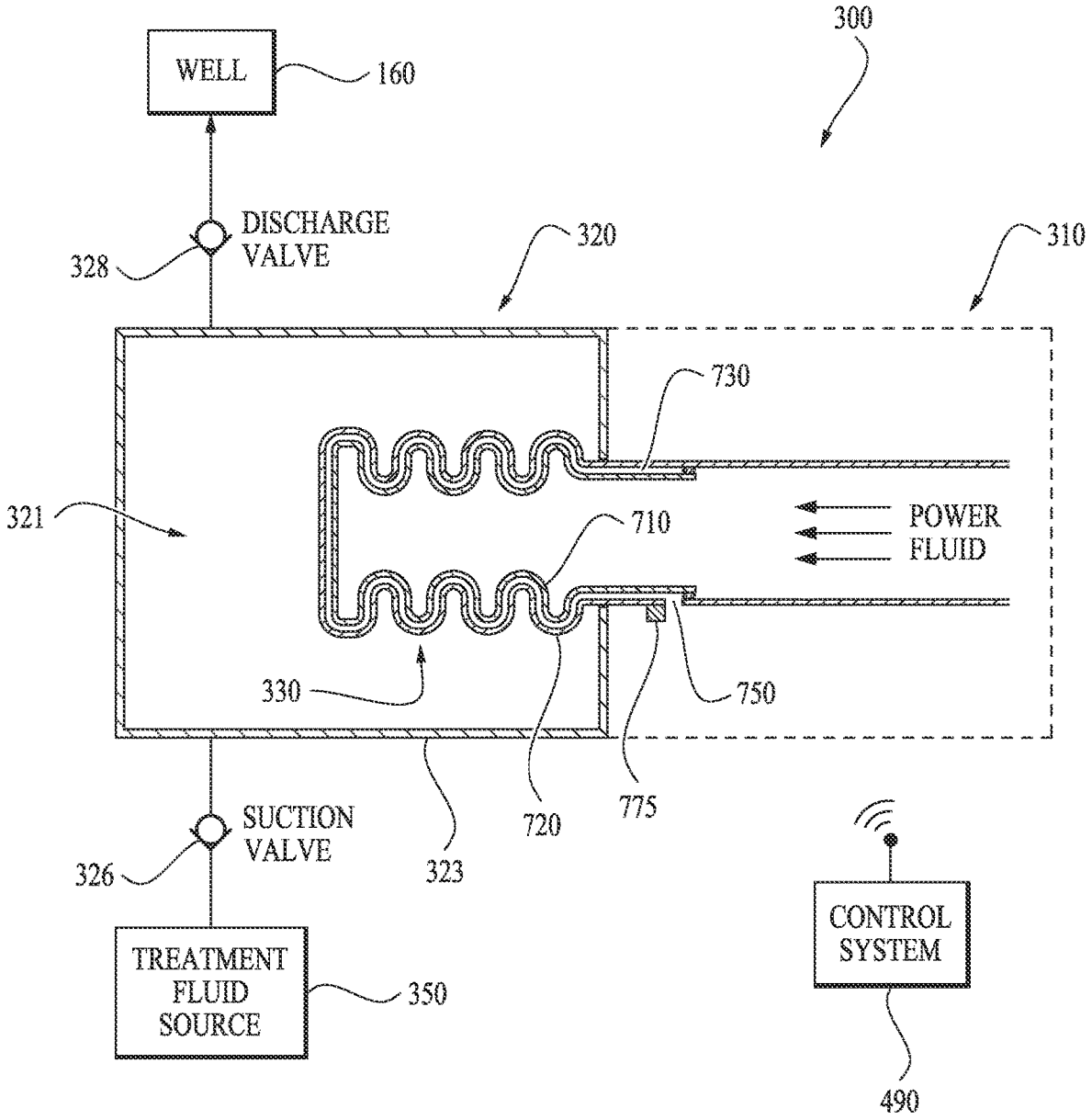
FIG. 7 is a schematic illustration of an exemplary bellows pump having a double-walled bellows, according to an embodiment of the disclosure.

FIG. 7 is a schematic illustration of an exemplary bellows pump 300 with double-walled bellows 330, according to one or more aspects of the present disclosure. The bellows pump 300 embodiment of FIG. 7 comprises an expandable double-walled bellows 330, which may be configured to extend into a chamber 321 of a fluid end 320 of the pump 300 based on application of drive fluid therein (e.g. from the power end 310 of the pump 300). In some embodiments, the double-walled bellows 330 may include an inner wall 710, enclosing an inner volume, and an outer wall 720 enclosing/surrounding/encompassing the inner wall 710. An annulus 730 (e.g. an annular space) is disposed/formed between the inner wall 710 and the outer wall 720 of the bellows 330, and the annulus 730 is in fluid communication with a port 750 (which in some embodiments may comprise a weep hole).

In embodiments, the annulus 730 may be configured to provide a sealed annular space between the inner wall 710 and the outer wall 720 of the bellows 330 with no fluid communication out (e.g. no fluid communication between the annulus 730 and an external environment) except via the port 750. In some embodiments, the annulus 730 is configured so that there is fluid connection between any portion of the annulus 730 and the port 750 (e.g. so that any fluid entering the annulus 730 (e.g. via leak) can move to the port 750. In some embodiments, the port 750 may be disposed in the housing of the power end 310 of the pump 300, while in other embodiments the port 750 may be disposed in the housing 323 for the fluid end 320 (e.g. external to the chamber 321).

In some embodiments, the inner wall 710 and outer wall 720 may be substantially uncoupled (e.g. not coupled together) within the chamber 321 (e.g. the portions of the inner wall 710 and the outer wall 720 disposed in the chamber 321 may be substantially uncoupled). In some embodiments, the annulus 730 may have an open space between the entirety (e.g. the entire portion) of the inner wall 710 and the outer wall 720 which is disposed in the chamber 321. In some embodiments, the inner wall 710 may be sealingly coupled to an interior surface of the outer wall 720, for example in proximity to the port 750 (e.g. with the port 750 disposed axially between the coupling of the inner wall 710 to the outer wall 720 and the chamber 321), in proximity to an opening in the bellows 330 configured to allow fluid flow between an inner volume of the bellows 330 and the power end 310 of the pump 300, and/or in proximity to or within the power end 310 (and in some embodiments, this may be the only coupling of the inner wall 710 to the outer wall 720). In other embodiments, the inner wall 710 may be coupled (e.g. at selective locations) to the outer wall 720 of the bellows 330 at other selective locations (e.g. within the chamber 321, in addition to coupling at their open ends), so long as one or more fluid pathways to the port 750 exist within the annulus 730 (e.g. so long as there is fluid connection between any portion of the annulus 730 and the port 750). In some embodiments, the majority (e.g. approximately 51-100%, 70-100%, 75-100%, 80-100%, 85-100%, 90-100%, 95-100%, 98-100%, 75-95%, 85-95%, 90-95%, 90-98%, or 95-98%) of the inner wall and the outer wall disposed in the chamber may be uncoupled (e.g. providing an inner wall 710 that is substantially uncoupled to the outer wall 720). In some embodiments, the open ends of the bag-like inner and outer walls 710, 720 may be sealingly coupled together in proximity to their open ends. In some embodiment, the outer wall 720 and/or the inner wall 710 may be coupled to the power end 310 (e.g. to a bore 420—see FIG. 4 for example—disposed in the power end 310). For example, some portion of the bellows 330 may extend into the power end 310 and be configured to receive drive fluid from the power end 310.

In some embodiments, the annulus 730 may be configured such that any fluid communication of drive fluid from the inner volume to the annulus 730 would be via a leak in the inner wall 710, and any leak of treatment fluid from the chamber 321 to the annulus 730 would be via leak in the outer wall 720. The annulus 730 may be configured so that any leak of fluid into the annulus 730 would be in fluid communication with the port 750. By having the port 750 in fluid communication with the annulus 730, the port 750 may be configured for leak detection. In some embodiments, leak detection may be via visual inspection (e.g. manual inspection by personnel at a weep hole). In some embodiments, one or more sensor 775 may be disposed in proximity to (e.g. proximate to, adjacent to, and/or abutting) the port 750, and the one or more sensor 775 may be configured to detect and/or monitor for leakage. For example, the one or more sensor 775 may be configured to detect/sense in the port (e.g. directed at or into the port, for example to detect with respect to any fluid leakage in the port and/or via the port).

In some embodiments, the annulus 730 may be configured to retain any leakage of drive fluid from the inner volume and/or to retain any leakage of treatment fluid (e.g. from the fluid end 320 of the pump 300, such as the chamber 321) into the bellows 330 (e.g. through the outer wall 720). In some pump 200 embodiments, the one or more sensor 775 may comprise a fluid sensor (e.g. in proximity to the port 750 and/or configured to detect the presence of fluid), such as a pressure sensor (e.g. a pressure transducer) and/or a contact (e.g. conduction) sensor. In some pump 300 embodiments, the one or more sensor 775 may comprise a contamination sensor (e.g. in proximity to the port 750 and/or configured to detect contaminants). In some embodiments, the contamination sensor may be configured to detect anything that is not drive fluid (e.g. detecting whether the fluid is or is not drive fluid or treatment fluid, thereby allowing for the type of leak to be identified). In some embodiments, the contamination sensor may be configured to detect the presence of particulates, solids, etc. in the fluid. In embodiments, the fluid sensor and/or contamination sensor may be included within the one or more sensor 775. In another embodiment, the annulus 730 may be filled with a fluid. For example, the fluid may be drive fluid or a third fluid with at least one property that is detectably different than the treatment fluid and the drive fluid (an example may be a fluid with a different conductivity). In such a case the detectable property would change when contaminated with either the treatment fluid or the drive fluid.

Typically, the inner wall 710 of the bellows 330 may be configured to be at least as expandable and contractible and/or at least as flexible as the outer wall 720. For example, the inner wall may be configured so that it will not restrain expansion and/or contraction of the expandable outer wall (e.g. during billows pumping movement). In some embodiments, the inner wall 710 and the outer wall 720 can be formed of the same/similar material. For example, in some embodiments both the inner wall 710 and the outer wall 720 may comprise a thin metal body (e.g. bag-like and/or formed of thin metal sheeting) having an accordion-like configuration (e.g. with pleats or convolutions configured to allow for expansion and/or contraction of the bellows 330). In some embodiments, both the inner wall 710 and the outer wall 720 may comprise an elastomer (e.g. configured to allow for expansion and/or contraction of the bellows 330). In some embodiments, both the inner wall 710 and the outer wall 710 may be formed of the same elastomeric material, while in other embodiments they may be formed of different elastomeric materials.

In some embodiments, the inner wall 710 and the outer wall 720 may be formed of different materials. For example, a first one of the inner wall 710 and the outer wall 720 may be formed of metal having an accordion-like configuration (e.g. similar to the discussion above), and a second one of the inner wall 710 and the outer wall 720 may be formed of an elastomeric material. For example, the outer wall 720 may be formed of metal having an accordion-like configuration, and the inner wall 710 may be formed of an elastomeric material. In some embodiments, the inner wall 710 may comprise an elastomeric liner (as discussed in more detail with respect to FIG. 8). In alternate embodiments, the outer wall 720 may be formed of an elastomeric material, and the inner wall 710 may be formed of metal having an accordion-like configuration. In embodiments, the elastomeric material of any walls of the bellows 330 (e.g. for the inner wall 710 and/or outer wall 720) may comprise one or more selected from the following: natural rubber, polyisoprene rubber, butyl rubber, chloroprene rubber, ethylene propylene diene rubber (EPDM), styrene butadiene rubber, silicone, urethanes, and combinations thereof.

In some embodiments, the inner wall 710 (e.g. the elastomeric liner) may be configured to be removable/replaceable (e.g. from within the outer wall 720 of the bellows 330). In some embodiments, the elastomeric material may be fatigue and/or abrasion resistant. In some embodiments, an interior surface of the outer wall 720 and/or an exterior surface of the inner wall 710 may include a low-friction material/coating (e.g. grease, PTFE, or other lubricant) and/or may be configured to minimize friction due to rubbing interaction of the inner and outer walls. 710, 720

Typically, the expandable bellows 330 may be configured to extend into the fluid end 320 of the pump 300, for example into the chamber 321 within the fluid end housing 323 having a suction valve 326 (in fluid communication with a treatment fluid source 350) and a discharge valve 328 (in fluid communication with a well). The pump 300 may also include a power end 310 in fluid communication with (e.g. fluidly coupled to) the bellows 330, which may be configured to apply (e.g. reciprocally) the drive fluid within the bellows 330. In some embodiments, the power end 310 may include a piston 410 (for example, as in FIG. 4) configured to reciprocally move fluid with respect to the bellows 330 (e.g. its inner volume), to expand/inflate the bellows 330 (e.g. on its discharge stroke) and to compress/deflate/retract the bellows 330 (e.g. on its suction stroke). For example, the piston 410 may translate axially within a bore 420 of the power end 310 which is in fluid communication with the inner volume within the bellows 330. In some embodiments, the piston 410 may be configured to not extend into the bellows 330 (e.g. during its discharge stroke, the piston 330 will not extend beyond the point of attachment of the inner wall 710 to the outer wall 720 of the bellows 330). In other embodiments, the piston 410 may be configured to (e.g. during its discharge stroke) partially extend into the bellows 330 (e.g. beyond the point of attachment of the inner wall 710 to the outer wall 720), but not to contact the bellows 330 (e.g. the piston 410 will not contact the inner wall 710 at the far end of the bellows 330 away from the power end 310). In some embodiments, the piston 410 may be part of or may be driven by an intensifier (e.g. configured to intensify applied pressure from the driver mechanism to the bellows 330, as discussed above in more detail—see for example FIG. 4). And as discussed above, different types of driver mechanisms may be used for the bellows pump 300.

As discussed above, the pump 300 may in some embodiments include a control system 490. For example, the control system 490 may be configured to receive data from the one or more sensor 775, compare the data to a corresponding threshold, and responsive to the data exceeding the threshold, initiate an action. In some embodiments, if any fluid is detected, action may be initiated (e.g. the threshold for fluid detection can be any measured fluid in the annulus). In some embodiments, there may be two or more different thresholds, and in some embodiments exceeding the different thresholds may result in different actions. For example, at a first/lower threshold, the control system 490 may send an alert, while at a second/higher threshold, the control system 490 may stop pumping (e.g. stopping movement of the piston and/or bellows and/or treatment fluid). In some embodiments, the action may comprise sending an alert and/or or stopping pumping (e.g. of treatment fluid into the well). In some embodiments, the control system 790 may be configured to evaluate the type of fluid detected by the one or more sensor 775 (e.g. at the port 750 and/or within the annulus 730). For example, data from the contamination sensor (e.g. a conductivity sensor) may be used to determine whether the leak (e.g. the fluid detected in the annulus 730) is drive fluid or treatment fluid. In some embodiments, the alert may indicate whether the fluid leak is drive fluid or treatment fluid. In some embodiments, different actions may be taken (e.g. automatically by the control system 490) depending on the type of fluid detected.

Figure 8:
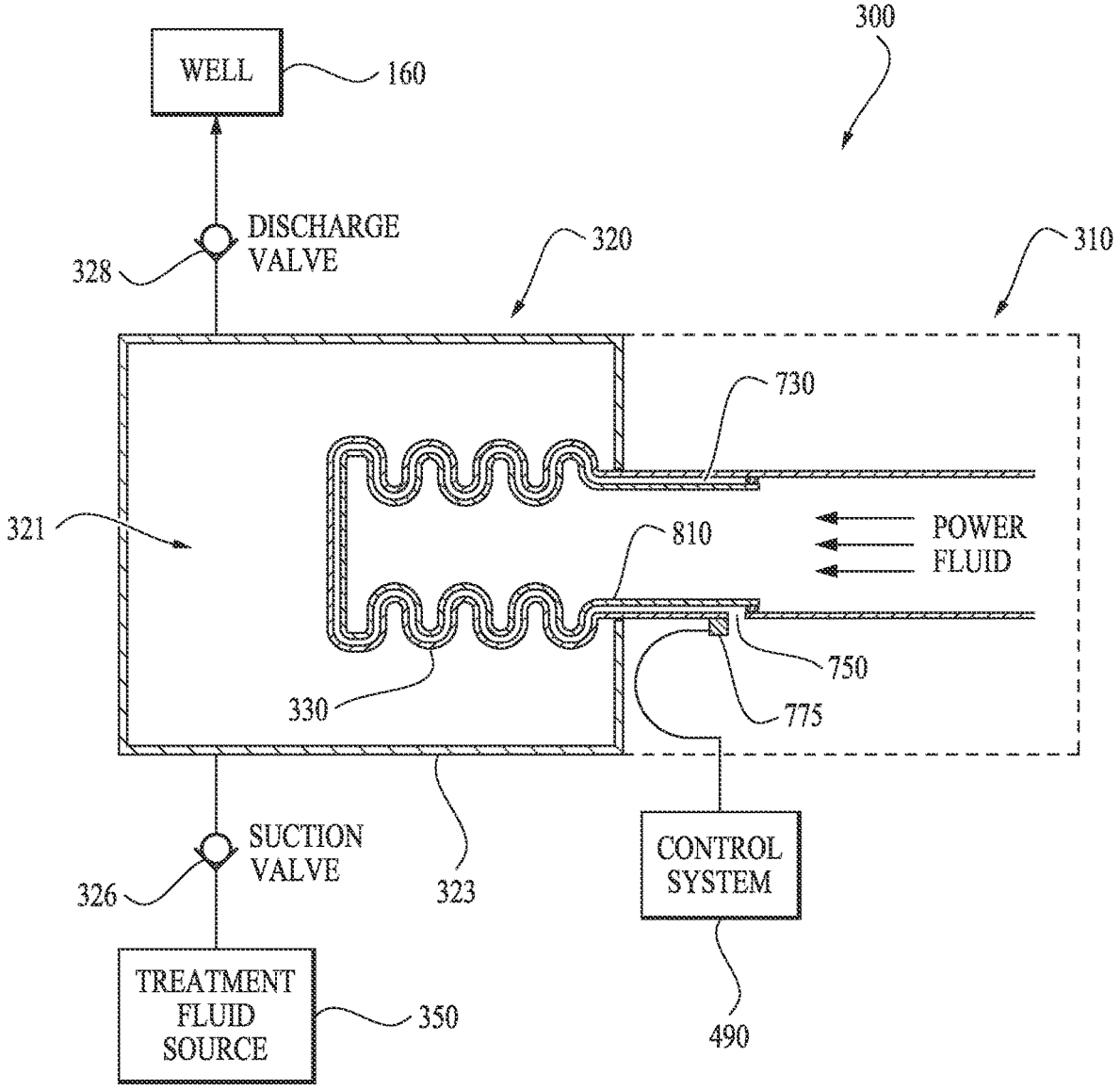
FIG. 8 is a schematic illustration of an exemplary bellows pump having a liner disposed within a bellows, according to an embodiment of the disclosure.

As mentioned above, in some embodiments, the double-walled bellows 330 (with annulus 730 between the walls) may be formed by having an elastomeric liner disposed within a bellows 330 (such as a single-walled bellows). FIG. 8 schematically illustrates an exemplary embodiment having an elastomeric liner 810 within a single-walled bellows 330. In some embodiments, the single-walled bellows 330 may be formed of a thin metal (e.g. a thin-sheeted hollow metal body) and/or have an accordion-like configuration. Generally, the embodiment depicted in FIG. 8 may function, operate, and/or be configured similarly to the exemplary embodiment shown in FIG. 7, for example with the inner wall 710 of FIG. 7 comprising (e.g. being formed by) the elastomeric liner 810 in FIG. 8, and the bellows 330 (e.g. single-walled bellows) shown in FIG. 8 forming the outer wall 720 discussed with respect to FIG. 7. The annulus 730 (e.g. annular space) can be disposed between the elastomeric liner 810 and the bellows 330 (and may be in fluid communication with the port 750, as discussed above). In embodiments, the elastomeric liner 810 may be loose or slip fit or unbonded within the bellows 330 (e.g. with the only coupling between the liner 810 and the bellows 330 being in proximity to their open ends and/or the port, and/or with the liner 810 being free to move within the bellows as the bellows reciprocally moves within the chamber).

In embodiments, the inner volume of the elastomeric liner 810 may be approximately the same (e.g. slightly less, due to the annulus) than that of the bellows 330. In embodiments, the elastomeric liner 810 may include or be formed of elastomeric material selected from the following: natural rubber, polyisoprene rubber, butyl rubber, chloroprene rubber, ethylene propylene diene rubber (EPDM), styrene butadiene rubber, silicone, urethanes, and combinations thereof. In embodiments, the elastomeric material may be fatigue and/or abrasion resistant. In some embodiments, the elastomeric liner 810 may be configured to be removable/replaceable. For example, the sealing coupling of the elastomeric liner 810 to the bellows 330 may be releasable. In some embodiments, the elastomeric liner 810 can extend out of the fluid end 320 (e.g. into the power end 310). In some embodiments, the elastomeric liner 810 may couple to the bellows 330 in proximity to or at the power end 310 (e.g. within the bore 420 of the power end 310). In some embodiment, in proximity to the port 750, the bellows 330 (e.g. outer wall 720) may couple to the power end 310 (e.g. the bore 420) and the elastomeric liner 810 (e.g. inner wall 710) may also couple to the power end 310 (e.g. the bore 420), with the points of attachment being axially displaced on either side of the port 750 (such that the annulus 730 is in fluid communication with the port 750). In some embodiments, the port 750 may be in fluid communication with the external environment (e.g. providing fluid communication therethrough between the annulus 730 and the external environment).

So in some embodiments (such as shown in FIG. 8), the elastomeric liner 810 may be added or placed within the inside of the bellows 330 (e.g. a conventional, single-walled bellows), to create the annulus 730 between the inner surface of the bellows 330 and the liner 810 (configured to contain drive fluid therein). In some embodiments, the elastomeric liner 810 may be loose, slip fit, or otherwise unbonded within the bellows 330 to create the annulus 730 structure. In certain embodiments, the elastomeric liner 810 may comprise multiple layers of the same material and/or different materials.

In some embodiments, the annulus 730 may be vented (e.g. at the port 750) in a manner that is visible from outside of the pump 300, e.g., by the operator. For example, the venting of the annulus 730 may be visible via a weep hole in the bellows 330. In some embodiments, the weep hole may be disposed in proximity to the bottom (e.g. downward with respect to gravitational orientation) of the bellows 330. In some embodiments, a vessel/container may be placed in proximity to the weep hole, for example to catch/collect any fluid exiting the annulus 730 through the weep hole. Any damage to the elastomeric liner 810 or the bellows 330 can cause the fluid presented at the weep hole (e.g. from the annulus 730) to leak out, which may indicate the failure of the bellows 330 and/or the liner 810. In some embodiments, the use of the elastomeric liner 810 within the inside of the bellows 330 may reduce or prevent contamination of the power end 310 drive fluid in the bellows 330 in the event of the failure of the bellows 330 or in the event of treatment fluid leakage. In some embodiments, the elastomeric liner 810 also may provide a layer of separation between the bellows 330 and the pressurized drive fluid in the pump 300, and early detection of any drive fluid leakage (e.g. in the annulus) may allow pumping to be stopped before there is damage to the bellows 330 and/or other pump 300 components (e.g. due to pressure imbalances).

In certain embodiments, the port 750 may be used as a slot for placing or coupling a sensor 775 (e.g. which may be directed into the port 750, for example towards any fluid coming from the annulus 730). As shown in FIG. 8, the port 750 may be located within the bellows 330 at or near an end (e.g. opening) of the elastomeric liner 810 (for example, in proximity to the coupling of the liner 810 to the bellows 330 and/or the power end housing/bore 420). However, in other embodiments the port 750 may be placed in other locations on the bellows 330. In some embodiments, the sensor 775 may include, but is not limited to, a pressure transducer or contact (conduction) type sensor. In certain embodiments, the sensor 775 may be configured to detect the presence and/or amount (e.g. including changes in the amount) of fluid or pressure near the annulus 730, which may be useful in assessing the health or wear and tear of the bellows 330. The detected information may be provided to the control system 490, which in some embodiments can display or provide the information to the operator or otherwise use the information to generate an alert, e.g., to the operator prompting the operator to take remedial measures with regard to the bellows pump 300. In some embodiments, the control system 490 may compare the detected information, e.g., information relating to the wear of the bellows 330, to a threshold value stored in the memory of the control system 490. This comparison may be used by the control system 490 to determine if the bellows 330 is sufficiently damaged to generate an alert and/or prompt other actions with regard to the system (some or all of which may be automated by the control system 490). In some embodiments, the alerts may automated pump 300 shutdown in the event of bellows 330 failure, among other reasons, to prevent additional failures of power end 310 components due to contamination of the power fluid in the bellows 330.

In certain embodiments, the port 750 may be given full visibility for monitoring visually or electronically. Any external leak point, such as a weep hole, may be monitored in real-time and alert the operator in the event of bellows 330 failure, for example to prevent catastrophic failure of power end 310 components due to contamination of the power fluid. In certain embodiments, one or more elastomeric liners 810 placed within the bellows 330 may help in preventing contamination of the power end fluid in the event of bellows 330 failure. Also, in certain embodiments of the present disclosure, a pressure transducer or fluid sensor may be placed at or near a weep hole or port 750 of the bellows-style pump 300 to detect a bellows 330 failure or potential failure (e.g. fluid leakage) and generate an electronic signal to an operator or automated operating system (e.g. control system 490) for indicating or alerting the bellows 330 failure or potential failure. Persons of skill will understand these and other bellows pump 300 embodiments based on the disclosure herein.

Disclosed embodiments also include exemplary methods for detecting leakage of a bellows pump 300, for example while the pump 300 is operating to pump treatment fluid into a well. For example, a method of detecting leakage in a bellows pump 300 may comprise: detecting fluid in an annulus 730 of an expandable double-walled bellows 330 (e.g. similar to the double-walled bellows pump embodiments disclosed herein). In some embodiments, detecting fluid in the annulus 730 may comprise visually inspecting a weep hole in fluid communication with the annulus 730. In other embodiments, detecting fluid in the annulus 730 may comprise detecting fluid via one or more sensor 775 in proximity to a port 750 in fluid communication with the annulus 730. In some embodiments, the one or more sensor 775 used for detection may include a fluid sensor and/or a contamination sensor.

Some method embodiments may further comprise comparing the detected fluid to a (e.g. corresponding) threshold, and taking action responsive to the detected fluid exceeding the threshold. For example, the control system 490 may receive data from the one or more sensor 775, compare the data to the threshold, and take action in response. In some embodiments, the method may further comprise using the bellows pump 300 to introduce/pump treatment fluid (e.g. fracturing fluid) into the well. In embodiments, the action taken (which may be performed, e.g. automatically, by a control system 490, for example receiving data from the one or more sensor) may be stopping introduction/pumping of treatment fluid and/or sending an alert (which may be visual or audio). In some embodiments, responsive to the detected fluid exceeding a first (e.g. lower) threshold, the action may be sending an alert; and responsive to the detected fluid exceeding a second (e.g. higher) threshold, the action may be automatically stopping movement of the bellows (e.g. stopping pumping of treatment fluid). In some embodiments, one or more action may be manual. In some embodiments, one or more action can be automatically taken by the control system 490 (e.g. configured to receive and/or analyze data from the one or more sensor 775).

Some method embodiments may also comprise placing the bellows pump 300 in fluid communication with the well (e.g. with the bellows pump 300 comprising the expandable double-walled bellows 330 having the annulus 730 between the walls 710, 720) and/or fluidly coupling a treatment fluid source 350 to the bellows pump 300 (e.g. such that pumping of the bellows pump 300 introduces treatment fluid from the treatment fluid source 350 into the well). In embodiments wherein the double-walled bellows at issue comprises an elastomeric liner 810 disposed within a single-walled bellows 330, then responsive to detecting fluid in excess of the threshold, the method can also comprise replacing the elastomeric liner 810 (e.g. removing the leaking liner from the single-walled bellows, placing a replacement liner within the bellows, and sealingly attaching the liner within the bellows).

In some embodiments, responsive to detecting a leak/fluid, the method may further comprise determining if the leak is or includes drive fluid or treatment fluid. In some embodiments, responsive to detecting a leak/fluid (e.g. and determining that the leak is drive fluid), the method may also include injecting drive fluid between the piston 410 and the bellows 330 (e.g. using a make-up system) to ensure that the bellows 330 and piston 410 are in sync. In some embodiments, responsive to detecting a leak/fluid (e.g. and determining that the leak is treatment fluid), the method may further include stopping pumping/introduction of fluid into the well. Such methods may be used in conjunction with any one of the double-walled bellows pumps 300 described herein.

Exemplary systems, including any one of the double-walled bellows pump 300 embodiments disclosed herein and/or implementing any one of the method embodiments herein, are also disclosed. For example, a system for pumping treatment fluid into a well may comprise: a bellows pump 300; a treatment fluid source 350; and a control system 490, wherein the pump 300 includes any one of the double-walled bellows pumps 300 disclosed herein. Some system embodiments may further comprise a driver for the power end 310 of the pump 300, which may be configured to induce reciprocating movement in the bellows 330 and/or the piston 410. The drive may include any type of driver mechanism configured to provide the reciprocal movement of the bellows 330, for example as discussed above. Some system embodiments may also comprise a make-up system in fluid communication with the bellows 330 (e.g. the inner volume), as discussed above.

ADDITIONAL DISCLOSURE

The following are non-limiting, specific embodiments in accordance with the present disclosure:

In a first embodiment, a pump comprises: an expandable double-walled bellows (e.g. configured to extend into a chamber of a fluid end of the pump based on application of drive fluid therein), comprising: an inner wall enclosing an inner volume; and an outer wall enclosing/surrounding/encompassing the inner wall; wherein an annulus (e.g. annular space) is disposed/formed between the inner wall and the outer wall of the bellows, and the annulus is in fluid communication with a port (e.g. weep hole).

A second embodiment can include the pump of the first embodiment, wherein the annulus is configured to provide a sealed annular space between the inner wall and the outer wall of the bellows with no fluid communication out (e.g. no fluid communication with an external environment) except via the port and/or there is fluid connection between any portion of the annulus and the port.

A third embodiment can include the pump of the first or second embodiments, wherein the inner and outer walls are substantially uncoupled (e.g. not coupled together) within the chamber (e.g. the portions of the inner wall and the outer wall disposed in the chamber are substantially uncoupled and/or the annulus comprises an open space between the entirety (e.g. the entire portion) of the inner wall and the outer wall which is disposed in the chamber) (e.g. with the inner wall loose or slip fit within the outer wall).

A fourth embodiment can include the pump of any one of the first to third embodiments, wherein the port is disposed in a housing of a power end of the pump.

A fifth embodiment can include the pump of any one of the first to fourth embodiments, wherein the port is disposed in a housing for the fluid end (e.g. external to the chamber).

A sixth embodiment can include the pump of any one of the first to fifth embodiments, wherein the inner wall is sealingly coupled to an interior surface of the outer wall in proximity to the port (e.g. with the port disposed axially between the coupling of the inner wall to the outer wall and the chamber) (which in some embodiments may also be in proximity to an opening in the bellows configured to allow fluid flow between an inner volume of the bellows and a power end of the pump and/or in proximity to or within the power end) (e.g. only coupled in proximity to the opening, the power end, and/or the port) (e.g. the open ends of the bag-like inner and outer walls may be sealingly coupled together in proximity to the open ends and/or may be coupled to the power end).

A seventh embodiment can include the pump of any one of the first to sixth embodiments, wherein the inner wall is coupled (e.g. at selective locations) to the outer wall of the bellows at other locations (e.g. within the chamber), so long as one or more fluid pathways to the port exist (e.g. so long as there is fluid connection between any portion of the annulus and the port).

An eighth embodiment can include the pump of any one of the first to seventh embodiments, wherein the annulus is configured such that any fluid communication of drive fluid from the inner volume to the annulus would be via a leak in the inner wall and any leak of treatment fluid from the chamber to the annulus would be via leak in the outer wall.

A ninth embodiment can include the pump of any one of the first to eighth embodiments, wherein any leak of fluid into the annulus would be in fluid communication with the port.

A tenth embodiment can include the pump of any one of the first to ninth embodiments, further comprising one or more sensor disposed in proximity to the port.

An eleventh embodiment can include the pump of any one of the first to tenth embodiments, wherein the annulus is configured to retain any leakage of drive fluid from the inner volume.

A twelfth embodiment can include the pump of any one of the first to eleventh embodiments, further comprising a fluid sensor (e.g. in proximity to the port), such as a pressure transducer and/or a contact (e.g. conduction) sensor and/or a pressure sensor, configured to detect the presence of fluid.

A thirteenth embodiment can include the pump of any one of the first to twelfth embodiments, wherein the annulus is configured to retain any leakage of treatment fluid (e.g. from the fluid end of the pump) into the bellows (e.g. through the outer wall).

A fourteenth embodiment can include the pump of any one of the first to thirteenth embodiments, further comprising a contamination sensor (e.g. in proximity to the port) configured to detect contaminants (e.g. anything that is not drive fluid) (e.g. detecting whether the fluid is or is not drive fluid or treatment fluid and/or detecting particulates, solids, etc. in the fluid).

A fifteenth embodiment can include the pump of any one of the first to fourteenth embodiments, wherein the inner wall is configured to be at least as expandable as the outer wall.

A sixteenth embodiment can include the pump of any one of the first to fifteenth embodiments, wherein the inner wall is configured to be at least as flexible as the outer wall.

A seventeenth embodiment can include the pump of any one of the first to sixteenth embodiments, wherein the inner wall and the outer wall are formed of the same/similar material (e.g. a metal having an accordion-like configuration or an elastomer).

An eighteenth embodiment can include the pump of any one of the first to sixteenth embodiments, wherein the inner wall and the outer wall are formed of different materials.

A nineteenth embodiment can include the pump of any one of the first to sixteenth or eighteenth embodiments, wherein a first of the inner wall and the outer wall is formed of metal having an accordion-like configuration, and a second of the inner wall and the outer wall is formed of an elastomeric material.

A twentieth embodiment can include the pump of any one of the seventeenth or nineteenth embodiments, wherein the elastomeric material is fatigue and/or abrasion resistant.

A twenty-first embodiment can include the pump of any one of the first to twentieth embodiments, wherein the inner wall is an elastomeric liner.

A twenty-second embodiment can include the pump of any one of the first to sixteenth and eighteenth to twentieth embodiments, wherein the outer wall is formed of metal having an accordion-like configuration, and the inner wall is formed of an elastomeric material (e.g. an elastomeric liner).

A twenty-third embodiment can include the pump of any one of the first to sixteenth and eighteenth to twentieth embodiments, wherein the outer wall is formed of an elastomeric material, and the inner wall is formed of metal having an accordion-like configuration.

A twenty-fourth embodiment can include the pump of any one of the twenty-first or twenty-second embodiments, wherein the elastomeric liner is configured to be removable/replaceable.

A twenty-fifth embodiment can include the pump of any one of the first to twenty-fourth embodiments, wherein an interior surface of the outer wall and/or an exterior surface of the inner wall comprises a low-friction material/coating (e.g. grease or other lubricant) (e.g. configured to minimize friction due to rubbing of the inner and outer walls).

A twenty-sixth embodiment can include the pump of any one of the first to twenty-fifth embodiments, wherein the expandable bellows is configured to extend into a fluid end (e.g. into a chamber within a fluid end housing having a suction valve (in fluid communication with a treatment fluid source) and a discharge valve (in fluid communication with a well)).

A twenty-seventh embodiment can include the pump of any one of the first to twenty-sixth embodiments, further comprising a power end in fluid communication with (e.g. fluidly coupled to) the bellows (e.g. configured to apply (e.g. reciprocally) drive fluid within the bellows).

A twenty-eighth embodiment can include the pump of the twenty-seventh embodiment, wherein the power end further comprises a piston configured to reciprocally move fluid with respect to the bellows (e.g. its inner volume) to expand/inflate the bellows (e.g. on its discharge stroke) and to compress/deflate/retract the bellows (e.g. on its suction stroke).

A twenty-ninth embodiment can include the pump of the twenty-eighth embodiment, wherein the piston is configured to not extend into the bellows (e.g. during its discharge stroke, the piston will not extend beyond the point of attachment of the inner wall to the outer wall of the bellows).

A thirtieth embodiment can include the pump of the twenty-eighth embodiment, wherein the piston is configured to (e.g. during its discharge stroke) partially extend into the bellows (e.g. beyond the point of attachment of the inner wall to the outer wall), but not to contact the bellows (e.g. the piston will not contact the inner wall at the far end of the bellows away from the power end).

A thirty-first embodiment can include the pump of any one of the twenty-seventh to thirtieth embodiments, wherein the power end further comprises an intensifier having a piston configured to reciprocally move fluid with respect to the bellows (e.g. inner volume) to expand/inflate the bellows (e.g. on its discharge stroke) and to compress/deflate/retract the bellows (e.g. on its suction stroke), wherein the piston comprises a head and a rod (e.g. disposed between the head and the fluid end/bellows, for example with the rod extending outward from the head towards the bellows), wherein the head has a larger diameter than the rod (such that pressure on the head will be intensified by the rod) (ex. approximately 1:1.1 to 1:10).

A thirty-second embodiment can include the pump of any one of the first to thirty-first embodiments, further comprising a control system configured to receive data from the one or more sensor (e.g. at the port), compare the data to a corresponding threshold, and, responsive to the data exceeding the threshold, initiate an action.

A thirty-third embodiment can include the pump of the thirty-second embodiment, wherein the threshold for fluid detection is any measured fluid in the annulus (e.g. if any fluid is detected, action may be initiated).

A thirty-fourth embodiment can include the pump of the thirty-second embodiment, wherein, at a lower threshold, the control system sends an alert, and at a higher threshold, the control system stops pumping (e.g. stops movement of the piston and/or bellows).

A thirty-fifth embodiment can include the pump of any one of the thirty-second to thirty-fourth embodiments, wherein the action comprises sending an alert and/or or stopping pumping (e.g. of treatment fluid into the well).

A thirty-sixth embodiment can include the pump of any one of the thirty-fourth to thirty-fifth embodiments, wherein the alert indicates whether the fluid leak is drive fluid or treatment fluid.

In a thirty-seventh embodiment, a bellows pump comprises: an expandable bellows (e.g. a single-walled bellows) configured to extend into a chamber of a fluid end of the pump based on application of drive fluid therein (e.g. within an inner volume of the bellows); and an elastomeric liner disposed within the bellows; wherein an annulus (e.g. annular space) is disposed between the elastomeric liner and the bellows, and the annulus is in fluid communication with a port (weep hole).

A thirty-eighth embodiment can include the pump of the thirty-seventh embodiment, further comprising the limitations set forth in any one of the second to thirty-sixth embodiments.

A thirty-ninth embodiment can include the pump of the thirty-eighth embodiment, wherein the bellows is the outer wall and the elastomeric liner is the inner wall.

In a fortieth embodiment, a bellows pump comprises: a power end; a fluid end having a fluid end housing with a chamber, a suction valve (e.g. configured for introduction of treatment fluid into the chamber), and a discharge valve (e.g. configured for injection of treatment fluid from the chamber into a well); an expandable bellows (e.g. single-walled and/or configured to expand into the chamber of the fluid end based on movement of drive fluid from the power end) (e.g. configured to separate/isolate drive fluid from treatment fluid); and an elastomeric liner disposed within the bellows; wherein an annulus (e.g. annular space) is disposed between the liner and the bellows, and the annulus is in fluid communication with a port (e.g. a weep hole).

A forty-first embodiment can include the pump of the fortieth embodiment, wherein the port is disposed in the power end.

A forty-second embodiment can include the pump of any one of the fortieth to forty-first embodiments, wherein the annulus is configured to provide a sealed annular space between the elastomeric liner and the bellows with no fluid communication out (e.g. no fluid communication with an external environment) except via the port and/or there is fluid connection between any portion of the annulus and the port.

A forty-third embodiment can include the pump of any one of the fortieth to forty-second embodiments, wherein the annulus comprises an open space between the entirety of the elastomeric liner and the bellows which is disposed in the chamber (e.g. the elastomeric liner and bellows are substantially uncoupled (e.g. not coupled together) within the chamber).

A forty-fourth embodiment can include the pump of any one of fortieth to forty-third embodiments, wherein the liner and bellows are substantially uncoupled (e.g. not coupled together) within the chamber (e.g. the portions of the liner and the bellows disposed in the chamber are substantially uncoupled) (e.g. with the liner loose or slip fit or unbonded within the bellows).

A forty-fifth embodiment can include the pump of any one of the fortieth to forty-fourth embodiments, wherein the elastomeric liner is sealingly coupled to an interior surface of the bellows (e.g. in proximity to an opening in the bellows configured to allow fluid flow between an inner volume of the bellows and a power end of the pump and/or in proximity to the port (with the port disposed axially between the coupling of the inner wall to the outer wall and the chamber) and/or in proximity to or within the power end).

A forty-sixth embodiment can include the pump of the forty-fifth embodiment, wherein the elastomeric liner is also coupled to the bellows at other locations (e.g. within the chamber), so long as fluid pathways to the annulus exist.

A forty-seventh embodiment can include the pump of any one of the fortieth to forty-sixth embodiments, wherein the annulus is configured such that any fluid communication of drive fluid from the inner volume of the liner to the annulus would be via a leak in the liner and any leak of treatment fluid from the chamber to the annulus would be via leak in the bellows.

A forty-eighth embodiment can include the pump of any one of the fortieth to forty-seventh embodiments, wherein any leak of fluid into the annulus would be in fluid communication with the port.

A forty-ninth embodiment can include the pump of any one of the fortieth to forty-eighth embodiments, wherein the port is the only opening in fluid communication with the annulus.

A fiftieth embodiment can include the pump of any one of the fortieth to forty-ninth embodiments, wherein the annulus is configured to retain any leakage of drive fluid from the inner volume.

A fifty-first embodiment can include the pump of any one of the fortieth to fiftieth embodiments, further comprising one or more sensor disposed in proximity to the port.

A fifty-second embodiment can include the pump of any one of the fortieth to fifty-first embodiments, further comprising a fluid sensor (e.g. in proximity to the port) configured to detect the presence of fluid (e.g. drive fluid) (e.g. wherein the fluid sensor may comprise a pressure sensor) (e.g. wherein the one or more sensor comprises a fluid sensor).

A fifty-third embodiment can include the pump of any one of the fortieth to fifty-second embodiments, wherein the annulus is configured to retain any leakage of treatment fluid (e.g. from the fluid end of the pump) into the annulus (e.g. through the bellows) (e.g. preventing treatment fluid from contacting/contaminating the drive fluid) (maintaining separation/isolation of treatment fluid from drive fluid).

A fifty-fourth embodiment can include the pump of any one of the fortieth to fifty-third embodiments, further comprising a contamination sensor (e.g. in proximity to the port) configured to detect contaminants (e.g. detecting whether the fluid is or is not drive fluid or treatment fluid and/or detecting particulates/solids in the fluid).

A fifty-fifth embodiment can include the pump of any one of the fortieth to fifty-fourth embodiments, wherein the elastomeric liner is configured to be at least as expandable as the bellows.

A fifty-sixth embodiment can include the pump of any one of the fortieth to fifty-fifth embodiments, wherein the elastomeric liner is configured to be at least as flexible as the bellows.

A fifty-seventh embodiment can include the pump of any one of the fortieth to fifty-sixth embodiments, wherein the inner volume of the elastomeric volume is approximately the same (e.g. slightly less) than that of the bellows.

A fifty-eighth embodiment can include the pump of any one of the fortieth to fifty-seventh embodiments, wherein the bellows is formed of a metal having an accordion-like configuration.

A fifty-ninth embodiment can include the pump of any one of the fortieth to fifty-eighth embodiments, wherein the elastomeric liner comprises an elastomeric material (e.g. one or more selected from the following: natural rubber, polyisoprene rubber, butyl rubber, chloroprene rubber, ethylene propylene diene rubber (EPDM), styrene butadiene rubber, silicone, urethanes, and combinations thereof).

A sixtieth embodiment can include the pump of any one of the fortieth to fifty-ninth embodiments, wherein the elastomeric material is fatigue and/or abrasion resistant.

A sixty-first embodiment can include the pump of any one of the fortieth to sixtieth embodiments, wherein the elastomeric liner is configured to be removable/replaceable.

A sixty-second embodiment can include the pump of any one of the fortieth to sixty-first embodiments, wherein the interior surface of the bellows and/or the exterior surface of the elastomeric liner comprises a low-friction material/coating (e.g. grease or other lubricant, such as PTFE) (configured to minimize friction due to rubbing of the elastomeric liner on the bellows).

A sixty-third embodiment can include the pump of any one of the fortieth to sixty-second embodiments, wherein the expandable bellows is configured to extend into the fluid end (e.g. into a chamber within a fluid end housing having a suction valve (in fluid communication with a treatment fluid source) and a discharge valve (in fluid communication with a well).

A sixty-fourth embodiment can include the pump of any one of the fortieth to sixty-third embodiments, wherein the power end further comprises a piston configured to reciprocally move fluid with respect to the bellows (e.g. inner volume) to expand/inflate the bellows (e.g. on its discharge stroke) and to compress/deflate/retract the bellows (e.g. on its suction stroke).

A sixty-fifth embodiment can include the pump of any one of the fortieth to sixty-fourth embodiments, wherein the power end further comprises an intensifier having a piston configured to reciprocally move fluid with respect to the bellows (e.g. inner volume) to expand/inflate the bellows (e.g. on its discharge stroke) and to compress/deflate/retract the bellows (e.g. on its suction stroke), wherein the piston comprises a head and a rod (e.g. disposed between the head and the fluid end/bellows), wherein the head has a larger diameter than the rod (such that pressure on the head will be intensified by the rod) (ex. approximately 1:1.1 to 1:10).

A sixty-sixth embodiment can include the pump of any one of the sixty-fourth to sixty-fifth embodiments, wherein the piston is configured to not extend into the bellows (e.g. during its discharge stroke, the piston will not extend beyond the point of attachment of the elastomeric liner to the bellows).

A sixty-seventh embodiment can include the pump of any one of the sixty-fourth to sixty-fifth embodiments, wherein the piston is configured to (e.g. during its discharge stroke) partially extend into the bellows (e.g. beyond the point of attachment of the inner wall to the outer wall), but not to contact the bellows (e.g. the piston will not contact the inner wall at the far end of the bellows).

A sixty-eighth embodiment can include the pump of any one of the fortieth to sixty-seventh embodiments, further comprising a control system configured to receive data from the one or more sensor (e.g. at the port), compare the data to a corresponding threshold, and, responsive to the data exceeding the threshold, initiate an action (e.g. in the event that a leak is detected).

A sixty-ninth embodiment can include the pump of the sixty-eighth embodiment, wherein the threshold for fluid detection is any measured fluid in the annulus.

A seventieth embodiment can include the pump of any one of the sixty-eight to sixty-ninth embodiments, wherein, at a lower threshold, the control system sends an alert, and at a higher threshold, the control system stops pumping.

A seventy-first embodiment can include the pump of any one of the sixty-eight to seventieth embodiments, wherein the action comprises sending an alert or stopping pumping (e.g. of treatment fluid into the well and/or of the bellows).

A seventy-second embodiment can include the pump of the seventy-first embodiment, wherein the alert indicates whether the fluid leak is drive fluid or treatment fluid.

A seventy-third embodiment can include the pump of any one of the fortieth to seventy-second embodiments, wherein the elastomeric liner extends out of the fluid end (e.g. into the power end) (e.g. and couples to the bellows in proximity to or at the power end).

A seventy-fourth embodiment can include the pump of any one of the fortieth to seventy-third embodiments, wherein the port is a weep hole configured for manual/visual inspection (e.g. visible external to the housing of the power end).

A seventy-fifth embodiment can include the pump of any one of the fortieth to seventy-fourth embodiments, wherein the port is disposed between the sealing coupling of the elastomeric liner to the bellows and the fluid end.

A seventy-sixth embodiment can include the pump of any one of the fortieth to seventy-fifth embodiments, wherein the port is disposed in a housing of the power end (although in other embodiments, the port may be disposed in the housing of the fluid end).

A seventy-seventh embodiment can include the pump of any one of the fortieth to seventy-sixth embodiments, wherein the treatment fluid is fracturing fluid.

In a seventy-eighth embodiment, a method of detecting leakage in a bellows pump, comprising: detecting fluid in an annulus of an expandable double-walled bellows, wherein detecting fluid comprises visually inspecting a weep hole in fluid communication with the annulus or detecting via one or more sensor in proximity to a port in fluid communication with the annulus.

A seventy-ninth embodiment can include the method of the seventy-eighth embodiment, further comprising using the bellows pump to introduce/pump treatment fluid (e.g. fracturing fluid) into a well.

An eightieth embodiment can include the method of the seventy-eighth or seventy-ninth embodiments, wherein the one or more sensor comprises a fluid sensor and/or a contamination sensor.

An eighty-first embodiment can include the method of any one of the seventy-eighth to eightieth embodiments, further comprising comparing the detected fluid to a (e.g. corresponding) threshold, and taking action responsive to the detected fluid exceeding the threshold.

An eighty-second embodiment can include the method of the eighty-first embodiment, wherein the action (which may be performed, e.g. automatically, by a control system, for example receiving data from the one or more sensor) is stopping introduction/pumping of treatment fluid and/or sending an alert.

An eighty-third embodiment can include the method of any one of the eighty-first or eighty-second embodiments, wherein, responsive to the detected fluid exceeding a first (e.g. lower) threshold, the action is sending an alert; and responsive to the detected fluid exceeding a second (e.g. higher) threshold, the action is automatically stopping movement of the bellows (e.g. stopping movement of power fluid).

An eighty-fourth embodiment can include the method of the eighty-third embodiment, wherein the action is automatically taken by a control system (e.g. configured to receive data from the one or more sensor).

An eighty-fifth embodiment can include the method of any one of the seventy-eighth to eighty-fourth embodiments, further comprising placing the bellows pump in fluid communication with a well, wherein the bellows pump comprises the expandable double-walled bellows having the annulus between the walls.

An eighty-sixth embodiment can include the method of any one of the seventy-eighth to eighty-fifth embodiments, further comprising fluidly coupling a treatment fluid source to the bellows pump (e.g. such that pumping of the bellows pump introduces treatment fluid from the treatment fluid source into the well).

An eighty-seventh embodiment can include the method of any one of the seventy-eighth to eighty-sixth embodiments, wherein the double-walled bellows comprises an elastomeric liner disposed within a single-walled bellows, and responsive to detecting fluid in excess of the threshold, replacing the elastomeric liner (e.g. removing the leaking liner from the single-walled bellows, placing a replacement liner within the bellows, and sealingly attaching the liner within the bellows).

An eighty-eighth embodiment can include the method of any one of the seventy-eighth to eighty-seventh embodiments, wherein responsive to detecting a leak/fluid, determining if it is drive fluid or treatment fluid.

An eighty-ninth embodiment can include the method of any one of the seventy-eighth to eighty-eighth embodiments, wherein responsive to detecting a leak/fluid (e.g. and determining that the leak is drive fluid), injecting drive fluid between the piston and the bellows (e.g. using a make-up system) to ensure that the bellows and piston are in sync.

A ninetieth embodiment can include the method of any one of the seventy-eighth to eighty-ninth embodiments, wherein responsive to detecting a leak/fluid (e.g. and determining that the leak is treatment fluid), stopping pumping/introduction of fluid into the well.

A ninety-first embodiment can include the method of any one of the seventy-eighth to ninetieth embodiments, wherein the bellows pump comprises any one of the pumps selected from the first to seventy-seventh embodiments.

In a ninety-second embodiment, a method comprises: providing a bellows pump at a well site that comprises at least one well bore that penetrates at least a portion of a subterranean formation, wherein the bellows pump comprises any one of the pumps selected from the first to seventy-seventh embodiments; using the bellows pump to introduce a treatment fluid into the well bore; and detecting fluid in the annulus of the bellows pump.

A ninety-third embodiment can include the method of the ninety-second embodiment, wherein responsive to detecting fluid, determining whether the fluid is drive fluid or treatment fluid.

A ninety-fourth embodiment can include the method of any one of the ninety-second to ninety-third embodiments, wherein responsive to detecting fluid, initiating an action.

In a ninety-fifth embodiment, a system for pumping treatment fluid into a well, comprising: a pump; a treatment fluid source; and a control system, wherein the pump comprises any one of the pumps selected from the first to seventy-seventh embodiments.

A ninety-sixth embodiment can include the system of the ninety-fifth embodiment, further comprising a driver for a power end of the pump, configured to induce reciprocating movement in the piston.

A ninety-seventh embodiment can include the system of the ninety-fifth or ninety-sixth embodiments, further comprising a make-up system in fluid communication with the bellows (e.g. the inner volume).

A ninety-eighth embodiment can include the system of any one of the ninety-fifth to ninety-seventh embodiments, further comprising a well.

In a ninety-ninth embodiment, a programmable storage device having program instructions stored thereon for causing a processor to perform the method according to any one of the seventy-eighth to ninety-fourth embodiments.

In a one hundredth embodiment, a non-transitory computer-readable medium having program instructions stored thereon for causing a control system to perform the method of any one of the seventy-eighth to ninety-fourth embodiments.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru−R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A pump for introducing high-pressure treatment fluid into a well, comprising:
- one or more sensors;
- a control system, and
- an expandable double-walled bellows configured to extend into a chamber of a fluid end of the pump based on application of drive fluid within the bellows, comprising:
  - an inner wall enclosing an inner volume; and
  - an outer wall encompassing the inner wall, such that the inner wall is disposed within the outer wall;
- wherein:
- a space is disposed between the inner wall and the outer wall of the bellows, and the space is in fluid communication with a port;
- at least one of the inner wall and the outer wall comprises an accordion-like body; and
- the bellows comprises a single opening configured to allow application of drive fluid into the inner volume of the bellows;
- the one or more sensors are configured to detect a fluid leak in the space; and
- the control system is configured to:
  - determine, based on the one or more sensors, whether the detected fluid leak is drive fluid or treatment fluid;
  - responsive to determining that the fluid leak is drive fluid, inject drive fluid between the piston and the bellows using a make-up system to ensure that the bellows and piston are in sync; and
  - responsive to determining that the fluid leak is treatment fluid, stop introduction of treatment fluid into the well.

2. The pump of claim 1, wherein the inner wall is sealingly coupled to an interior surface of the outer wall in proximity to the port, but the inner wall and the outer wall are substantially uncoupled within the chamber.

3. The pump of claim 1, wherein the one or more sensors are disposed in proximity to the port.

4. The pump of claim 1, wherein the one or more sensors comprise a fluid sensor in proximity to the port, configured to detect the presence of fluid, or a contamination sensor in proximity to the port.

5. The pump of claim 1, wherein the inner wall is configured to be at least as expandable as the outer wall.

6. The pump of claim 1, wherein a first one of the inner wall and the outer wall is formed of metal having an accordion-like configuration, and a second one of the inner wall and the outer wall is formed of an elastomeric material.

7. The pump of claim 3, wherein the control system is configured to receive data from the one or more sensors, compare the data to a corresponding threshold, and responsive to the data exceeding the threshold, initiate an action.

8. A bellows pump for introducing treatment fluid into a well for treatment of the well, comprising:
- a power end;
- a fluid end having a fluid end housing with a chamber, a suction valve configured for introduction of treatment fluid into the chamber, and a discharge valve configured for injection of treatment fluid from the chamber into the well;

an expandable bellows configured to expand into the chamber of the fluid end based on movement of drive fluid from the power end and configured to separate drive fluid from treatment fluid;

an elastomeric liner disposed within the bellows;

one or more sensors; and a control system, wherein:

a space is disposed between the liner and the bellows, the space is in fluid communication with a port, the treatment fluid comprises one of the following: fracturing fluid, abrasive material, corrosive material, cement, proppant, or combinations thereof, the one or more sensors are configured to detect a fluid leak in the space; and the control system is configured to:

determine based on the one or more sensors, whether the detected fluid leak is drive fluid or treatment fluid;

responsive to determining that the fluid leak is drive fluid, inject drive fluid between the piston and the bellows using a make-up system to ensure that the bellows and piston are in sync; and responsive to determining that the fluid leak is treatment fluid, stop introduction of treatment fluid into the well.

9. The bellows pump of claim 8, wherein the elastomeric liner is sealingly coupled to an interior surface of the bellows in proximity to the port, but otherwise is loose or slip fit within the bellows.

10. The bellows pump of claim 8, wherein the one or more sensors are disposed in proximity to the port, wherein the one or more sensors are selected from the following: a fluid sensor configured to detect the presence of fluid and/or a contamination sensor configured to detect contaminants within fluid.

11. The bellow pump of claim 10, wherein the control system is configured to receive data from the one or more sensors, compare the data to a corresponding threshold, and, responsive to the data exceeding the threshold, initiate an action.

12. The bellows pump of claim 8, wherein the elastomeric liner is configured to be at least as expandable as the bellows.

13. The bellows pump of claim 8, wherein the bellows is formed of a metal and has an accordion-like configuration.

14. A method of detecting leakage in a bellows pump, comprising:

placing the bellows pump in fluid communication with a hydrocarbon well wherein the bellows pump comprises an expandable double-walled bellows having space between the walls, using the bellows pump to introduce treatment fluid into the well for one of the following:

a hydraulic fracturing operation, a fracturing acidizing operation, a proppant hydraulic fracturing operation, a well stimulation treatment drilling, cementing or combinations thereof; and detecting leak fluid in the space between the walls of the expandable double-walled bellows, wherein detecting leak fluid comprises detecting via one or more sensors in proximity to a port in fluid communication with the space;

wherein responsive to detecting leak fluid, determining based on the one or more sensors whether the detected leak fluid is drive fluid or treatment fluid;

responsive to determining that the leak fluid is drive fluid, injecting drive fluid between the piston and the bellows; and responsive to determining that the leak fluid is treatment fluid, stopping introduction of treatment fluid into the well.

15. The method of claim 14, further comprising comparing detected leak fluid to a corresponding threshold, and acting responsive to the detected leak fluid exceeding the threshold.

16. The method of claim 14, wherein the double-walled bellows comprises an elastomeric liner disposed within a single-walled bellows, further comprising, responsive to determining that the leak fluid is drive fluid, replacing the elastomeric liner; or responsive to determining that the leak fluid is treatment fluid, replacing the single-walled bellows.

17. The method of claim 14, wherein:

a control system determines, based on the one or more sensors, whether the detected leak fluid is drive fluid or treatment fluid;

responsive to determining that the leak fluid is drive fluid, the control system injects drive fluid between the piston and the bellows using a make-up system to ensure that the bellows and piston are in sync; and responsive to determining that the leak fluid is treatment fluid, the control system stops introduction of treatment fluid into the well.

18. A pump for introducing high-pressure treatment fluid into a well, comprising:

an expandable double-walled bellows configured to extend into a chamber of a fluid end of the pump based on application of drive fluid within the bellows, comprising:

an inner wall enclosing an inner volume; and an outer wall encompassing the inner wall;

wherein:

a space is disposed between the inner wall and the outer wall of the bellows, the space is in fluid communication with a port, the inner wall and the outer wall have rubbing interaction based on application of drive fluid within the bellows and an interior surface of the outer wall or an exterior surface of the inner wall comprises a low-friction material configured to minimize friction due to rubbing of the inner and outer walls.

19. The pump of claim 18, wherein the low-friction material comprises grease, PTFE, or other lubricant.

* * * * *